US010871353B2

(12) United States Patent
Down et al.

(10) Patent No.: US 10,871,353 B2
(45) Date of Patent: Dec. 22, 2020

(54) SYSTEM FOR DEPLOYING A FIRST OBJECT FOR CAPTURING, IMMOBILISING OR DISABLING A SECOND OBJECT

(71) Applicants: OPENWORKS ENGINEERING LTD, Northumberland (GB); Christopher David Down, Newcastle (GB); Neil Rockcliffe Armstrong, Rowlands Gill (GB); James Edward Cross, Blaydon (GB); Alexander James Wilkinson, Newcastle (GB); Roland Sebastian Wilkinson, Newcastle (GB)

(72) Inventors: Christopher David Down, Newcastle (GB); Neil Rockcliffe Armstrong, Rowlands Gill (GB); James Edward Cross, Blaydon (GB); Alexander James Wilkinson, Newcastle (GB); Roland Sebastian Wilkinson, Newcastle (GB)

(73) Assignee: OPENWORKS ENGINEERING LTD, Northumberland (GB)

( * ) Notice: Subject to any disclaimer, the term of this patent is extended or adjusted under 35 U.S.C. 154(b) by 0 days.

(21) Appl. No.: 15/567,743

(22) PCT Filed: Apr. 22, 2016

(86) PCT No.: PCT/GB2016/051139

§ 371 (c)(1),
(2) Date: Oct. 19, 2017

(87) PCT Pub. No.: WO2016/170367

PCT Pub. Date: Oct. 27, 2016

(65) Prior Publication Data

US 2018/0094908 A1 Apr. 5, 2018

(30) Foreign Application Priority Data

Apr. 22, 2015 (GB) ..... 1506889.3
Jun. 1, 2015 (GB) ..... 1509456.8
Jan. 22, 2016 (GB) ..... 1601228.8

(51) Int. Cl.
*G06C 15/00* (2006.01)
*F41H 11/02* (2006.01)
(Continued)

(52) U.S. Cl.
CPC ..... *F41H 11/02* (2013.01); *F41G 1/473* (2013.01); *F41G 3/06* (2013.01); *F41G 3/16* (2013.01); *F41H 13/0006* (2013.01)

(58) Field of Classification Search
CPC ..... F41H 11/02; F41H 13/0006
(Continued)

(56) References Cited

U.S. PATENT DOCUMENTS 1,309,530 A 7/1919 Lamberson
4,967,667 A 11/1990 Horwath
(Continued)

FOREIGN PATENT DOCUMENTS

DE 8536735 U1 9/1987
DE 19952437 A 5/2001
(Continued)

OTHER PUBLICATIONS

Office Action for U.S. Appl. No. 15/577,978, dated May 24, 2019.
(Continued)

*Primary Examiner* — Karl D Frech
(74) *Attorney, Agent, or Firm* — Jason H. Vick; Sheridan Ross, PC

(57) ABSTRACT

A system for deploying a first object for capturing, immobilising or disabling a second object is provided. The system
(Continued)

comprises the first object, a projectile for carrying the first object therein, and a launcher for launching the projectile towards the second object, wherein the projectile is configured for deploying the first object in the vicinity of the second object for capturing, immobilising or disabling the second object.

6 Claims, 26 Drawing Sheets

(51) Int. Cl.

| | |
|---|---|
| ***F41H 13/00*** | (2006.01) |
| ***F41G 3/06*** | (2006.01) |
| ***F41G 1/473*** | (2006.01) |
| ***F41G 3/16*** | (2006.01) |

(58) Field of Classification Search
USPC ..... 235/411
See application file for complete search history.

(56) References Cited

U.S. PATENT DOCUMENTS

| | | | |
|---|---|---|---|
| 5,192,827 | A | 3/1993 | Jasper, Jr. |
| 5,430,448 | A | 7/1995 | Bushman |
| 5,503,059 | A | 4/1996 | Pacholok |
| 5,583,311 | A | 12/1996 | Rieger |
| 6,085,735 | A | 7/2000 | Cheek, Jr. |
| 6,499,382 | B1 | 12/2002 | Lougheed et al. |
| 6,626,077 | B1 | 9/2003 | Gilbert |
| 6,763,822 | B1 | 7/2004 | Styles |
| 7,210,875 | B1 | 5/2007 | Christie et al. |
| 8,205,537 | B1 | 6/2012 | Dupont |
| 2003/0000372 | A1 | 1/2003 | Meyers et al. |
| 2005/0168375 | A1 | 8/2005 | Halladay et al. |
| 2006/0000348 | A1 | 1/2006 | Boyd |
| 2007/0023582 | A1 | 2/2007 | Steele et al. |
| 2007/0169616 | A1 | 7/2007 | Vickroy |
| 2007/0261542 | A1 | 11/2007 | Chang et al. |
| 2008/0017752 | A1 | 1/2008 | Shukrun |
| 2009/0114761 | A1 | 5/2009 | Sells, II |
| 2009/0288550 | A1 | 11/2009 | Willner |
| 2010/0181424 | A1 | 7/2010 | Goossen et al. |
| 2010/0282057 | A1 | 11/2010 | Rapp et al. |
| 2010/0300346 | A1 | 12/2010 | Gayton |
| 2011/0010981 | A1 | 1/2011 | Wieland |
| 2011/0101097 | A1 | 5/2011 | Olden et al. |
| 2011/0226889 | A1 | 9/2011 | Rovinsky |
| 2012/0138681 | A1 | 6/2012 | Schneider et al. |
| 2012/0210904 | A1 | 8/2012 | Merems |
| 2014/0216290 | A1 | 8/2014 | Yee et al. |
| 2014/0331984 | A1 | 11/2014 | Brahler, II et al. |
| 2017/0059692 | A1 | 3/2017 | Laufer et al. |
| 2017/0101179 | A1 | 4/2017 | Michael |
| 2018/0335779 | A1 | 11/2018 | Fisher et al. |

FOREIGN PATENT DOCUMENTS

| | | | |
|---|---|---|---|
| EP | 2138802 | A1 | 12/2009 |
| EP | 2150767 | A1 | 2/2010 |
| FR | 2965908 | A | 4/2012 |
| GB | 2487664 | | 8/2012 |
| JP | 2001-147099 | A | 5/2001 |
| KR | 101411946 | B1 | 6/2014 |
| SE | 456813 | B | 11/1988 |
| WO | WO 97/14931 | | 4/1997 |
| WO | WO 2008/050343 | | 5/2008 |
| WO | WO 2016/193722 | | 12/2016 |

OTHER PUBLICATIONS

Office Action for U.S. Appl. No. 15/577,978, dated Dec. 17, 2018.
Partial European Search Report for corresponding European Application No. 19178588.0, dated Oct. 2, 2019.
Extended European Search Report for corresponding European Application No. 19178588.0, dated Jan. 22, 2020.
Notice of Allowance for U.S. Appl. No. 15/577,978, dated Oct. 30, 2019.
Examination Report for Great Britain Patent Application No. GB 1509456.8, dated May 26, 2020.
U.S. Appl. No. 15/577,978, filed Nov. 29, 2017, Down et al.
Bunting PartyDelights, PartyDelights.co.uk; Available from: http://www.partydelights.co.uk/decorations/bunting.aspx?pmo=7&gclid=CLvH-6ncuscoCFSUewwodOCcG5Q; Accessed Jan. 21, 2016.
International Preliminary Report on Patentability for International Application No. PCT/GB2016/051139, dated Nov. 2, 2017.
International Search Report for International Application No. PCT/GB2016/051607 dated Sep. 7, 2016.
Written Opinion for International Application No. PCT/GB2016/051607 dated Sep. 7, 2016.
International Preliminary Report on Patentability for International Application No. PCT/GB2016/051607 dated Dec. 5, 2017.
Search Report for Great Britain Patent Application No. GB 1509457.6, dated May 10, 2016.
Bagley Stamping "Rag Rug" WorldPress.com; Feb. 16, 2010.
QINETIQ "Exceptional Vehicle Stopping Power. Breakthrough Technology. X-Net"; Available from: http://qinetiq.com/services-products/survivability/infrastructure-and-base-protection/documents/Xnet.pdf; 2009.
International Search Report for International Application No. PCT/GB2016/051139, dated Jul. 26, 2016.
Written Opinion for International Application No. PCT/GB2016/051139, dated Jul. 26, 2016.
Search Report for Great Britain Patent Application No. 1506889.3, dated Dec. 15, 2015.
Search Report for Great Britain Patent Application No. 1509456.8, dated Jan. 22, 2016.
Search Report for Great Britain Patent Application No. 1601228.8, dated Mar. 14, 2016.

SYSTEM FOR DEPLOYING A FIRST OBJECT FOR CAPTURING, IMMOBILISING OR DISABLING A SECOND OBJECT

CROSS REFERENCE TO RELATED APPLICATIONS

This application is a national stage application under 35 U.S.C. 371 of PCT Application No. PCT/GB2016/051139, having an international filing date of 22 Apr. 2016, which designated the United States, which PCT application claimed the benefit of Great Britain Application Nos. 1506889.3, filed 22 Apr. 2015, 1509456.8, filed 1 Jun. 2015, and 1601228.8, filed 22 Jan. 2016, each of which are incorporated herein by reference in their entirety.

FIELD OF THE INVENTION

The present invention relates to a system for deploying a first object for capturing, immobilising or disabling a second object. For example, certain exemplary embodiments provide a system for deploying a net to capture, immobilise or disable an aerial vehicle (e.g. an aerial drone) that is located a relatively large distance from an operator of the system.

BACKGROUND OF THE INVENTION

The ability to capture, immobilise or disable a remote object is desirable in many situations. For example, for reason of security, safety, privacy and/or legality, it is desirable to be able to capture, immobile or disable any vehicle (e.g. aerial vehicle) that has entered a certain space (e.g. airspace) without authorisation. The problem of unauthorised use of aerial vehicles has increased greatly with the increased commercial availability of cheap, small Unmanned Aerial Vehicles (UAV), for example quadcopters.

For example, there has been increasing concern in the security industry that a UAV may be used in an attempted terrorist attack, for example to deliver explosives, or disperse chemical or biological agents, to a crowded area, building, structure or installation. Other examples of unauthorised or undesirable UAV use include use of UAVs to smuggle contraband into prisons and across borders, use of UAVs near airports which can be a safety concern due to potential collision with aircraft, and use of UAVs above sports stadia for the purpose of illegal viewing and/or recording of sports events.

Various techniques may be used to capture, immobilise or disable an object such as an aerial vehicle. A first technique involves shooting the vehicle down. However, this technique suffers various disadvantages, including (i) being potentially dangerous (for example due to stray bullets or falling debris), (ii) being liable to cause the public worry or anxiety, (iii) potentially destroying the vehicle and/or useful forensic evidence, and (iv) in the case of an attempted terrorist attack, possibly causing detonation of any explosives, or release of any chemical or biological agents, being carried by the vehicle.

A second technique involves using a second aerial vehicle (e.g. a UAV) to intercept and capture the first aerial vehicle while it is still in the air. However, one problem with this technique is that, when the first vehicle is not static, the second vehicle should be both large enough to carry the weight of the first vehicle following capture, and yet be more agile than the first vehicle to make intercept and capture possible. Achieving both of these design requirements may be complex and costly, and in some cases may not be possible in practice. Another problem with this technique is that it requires a skilled operator to enable the second vehicle to intercept and capture the first vehicle.

A third technique involves providing a fixed installation, or a fixed network of installations, capable of detecting an unauthorised aerial vehicle and immobilising it by dispersing immobilising means, such as nets and foam, in the air in the forward path of the vehicle. However, this technique suffers various disadvantages including (i) being restricted to protecting a fixed area, (i) being relatively complex and expensive due to the sophisticated sensor network required for detecting and locating a vehicle, and (iii) requiring a high skill level to operate and maintain.

A fourth technique involves using a conventional net gun to bring down the aerial vehicle. For example, according to a typical net gun design, a number of weights are fired in divergent directions, wherein each weight is attached to the perimeter of a net such that the net is pulled forward by the weights and spreads out as it travels forward. One problem with this technique is that a conventional net gun has a relatively limited range due to aerodynamic drag on the net. Another problem is that when the vehicle is captured by the net and falls to the ground, it may pose a danger to people on the ground and/or may cause damage.

Accordingly, what is desired is a system for capturing, immobilising or disabling an object (for example and aerial vehicle) that is safe and easy to use, is not unduly complex, has a relatively long range, is mobile, avoids destruction of the object, avoids damage to surrounding buildings or structures, and is not a danger to the public.

The above information is presented as background information only to assist with an understanding of the present disclosure. No determination has been made, and no assertion is made, as to whether any of the above might be applicable as prior art with regard to the present invention.

SUMMARY OF THE INVENTION

It is an aim of certain embodiments of the present invention to address, solve, mitigate or obviate, at least partly, at least one of the problems and/or disadvantages associated with the related art, for example at least one of the problems and/or disadvantages mentioned herein. Certain embodiments of the present invention aim to provide at least one advantage over the related art, for example at least one of the advantages mentioned herein.

The present invention is defined by the independent claims. A non-exhaustive set of advantageous features that may be used in various exemplary embodiments of the present invention are defined in the dependent claims.

In accordance with an aspect of the present invention, there is provided a system for deploying a first object for capturing, immobilising or disabling a second object, the system comprising: the first object; a projectile for carrying the first object therein; and a launcher for launching the projectile towards the second object, wherein the projectile is configured for deploying the first object in the vicinity of the second object for capturing, immobilising or disabling the second object.

In accordance with another aspect of the present invention, there is provided a projectile for deploying a first object for capturing, immobilising or disabling a second object, the projectile comprising: a projectile body including a first compartment for storing the first object; a first deployment mechanism for deploying the first object; and control circuitry for activating the first deployment mechanism.

In accordance with another aspect of the present invention, there is provided a launcher for launching a projectile, the launcher comprising: a barrel configured to receive the projectile; a launching mechanism for launching the projectile; an aiming mechanism for aiming the barrel; and control circuitry for controlling the launching mechanism.

In accordance with another aspect of the present invention, there is provided an aiming mechanism comprising: an attachment means for attaching the aiming mechanism to a barrel of a projectile launcher; a sight for allowing a user to visually acquire a target object; a range finder for measuring the distance to the target object in a direct line of sight; a direction sensor for measuring the direction of the target object, including at least the zenith angle of the target object with respect to a horizontal plane; an actuator for adjusting the direction of the barrel relative to the direct line of sight, including at least the zenith angle; and a processor for controlling the actuator to adjust the direction of the barrel based on the measure distance and direction of the target object.

In accordance with another aspect of the present invention, there is provided a net comprising a net body, wherein the net body comprises a net pattern adapted to entangle the rotating elements of a vehicle.

In accordance with another aspect of the present invention, there is provide a computer program comprising instructions arranged, when executed, to implement a method, device, apparatus and/or system in accordance with any aspect, embodiment, example or claim disclosed herein. In accordance with another aspect of the present invention, there is provided a machine-readable storage storing such a program.

Other aspects, advantages, and salient features of the present invention will become apparent to those skilled in the art from the following detailed description, which, taken in conjunction with the annexed drawings, disclose exemplary embodiments of the present invention.

DETAILED DESCRIPTION OF EXEMPLARY EMBODIMENTS

Figure 1A:
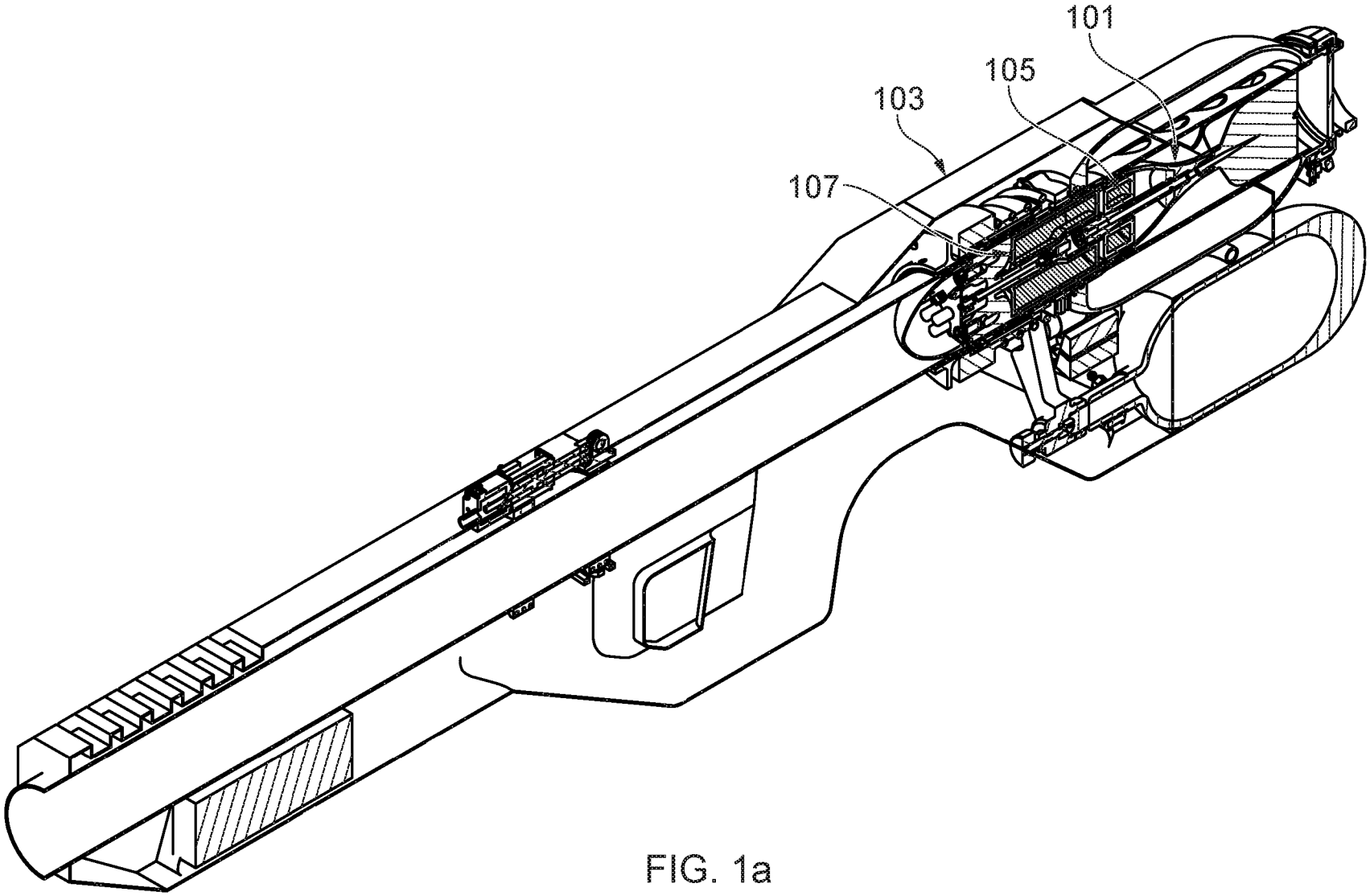
FIGS. 1*a-c* illustrate a system according to an exemplary embodiment of the present invention.

The following description of exemplary embodiments of the present invention, with reference to the accompanying drawings, is provided to assist in a comprehensive understanding of the present invention, as defined by the claims. The description includes various specific details to assist in that understanding but these are to be regarded as merely exemplary. Accordingly, those of ordinary skill in the art will recognize that various changes and modifications of the embodiments described herein can be made without departing from the scope of the present invention, as defined by the claims.

The terms and words used in this specification are not limited to the bibliographical meanings, but, are merely used to enable a clear and consistent understanding of the present invention.

The same or similar components may be designated by the same or similar reference numerals, although they may be illustrated in different drawings.

Detailed descriptions of elements, features, components, structures, constructions, functions, operations, processes, characteristics, properties, integers and steps known in the art may be omitted for clarity and conciseness, and to avoid obscuring the subject matter of the present invention.

Throughout this specification, the words "comprises", "includes", "contains" and "has", and variations of these words, for example "comprise" and "comprising", means "including but not limited to", and is not intended to (and does not) exclude other elements, features, components, structures, constructions, functions, operations, processes, characteristics, properties, integers, steps and/or groups thereof.

Throughout this specification, the singular forms "a", "an" and "the" include plural referents unless the context dictates otherwise. For example, reference to "an object" includes reference to one or more of such objects.

By the term "substantially" it is meant that the recited characteristic, parameter or value need not be achieved exactly, but that deviations or variations, including for example, tolerances, measurement errors, measurement accuracy limitations and other factors known to those of skill in the art, may occur in amounts that do not preclude the effect the characteristic, parameter or value was intended to provide.

Throughout this specification, language in the general form of "X for Y" (where Y is some action, process, function, activity, operation or step and X is some means for carrying out that action, process, function, activity, operation or step) encompasses means X adapted, configured or arranged specifically, but not exclusively, to do Y.

Elements, features, components, structures, constructions, functions, operations, processes, characteristics, properties, integers, steps and/or groups thereof described herein in conjunction with a particular aspect, embodiment, example or claim are to be understood to be applicable to any other aspect, embodiment, example or claim disclosed herein unless incompatible therewith.

It will be appreciated that embodiments of the present invention can be realized in the form of hardware or a combination of hardware and software. Any such software may be stored in any suitable form of volatile or non-volatile storage device or medium, for example a ROM, RAM, memory chip, integrated circuit, or an optically or magnetically readable medium (e.g. CD, DVD, magnetic disk or magnetic tape). It will also be appreciated that storage devices and media are embodiments of machine-readable storage that are suitable for storing a program or programs comprising instructions that, when executed, implement embodiments of the present invention.

Embodiments of the present invention provide a system for deploying a first object for capturing, immobilising or disabling a second object. An exemplary system embodying the present invention comprises the first object, a projectile and a launcher. The projectile is configured for transporting the first object to the vicinity of the second object. The launcher is configured for launching the projectile. The projectile is further configured for deploying the first object in the vicinity of the second object. Following deployment, the first object is configured for capturing, immobilising or disabling the second object.

Various features of an exemplary embodiment will now be described in detail. It is understood that these features may be provided in any suitable combination in various embodiments. For example, in certain embodiments, one or more features may be omitted, one or more additional features may be provided, and/or one or more features may be replaced with one or more alternative features for performing equivalent functions.

Overall System

Figure 1B:
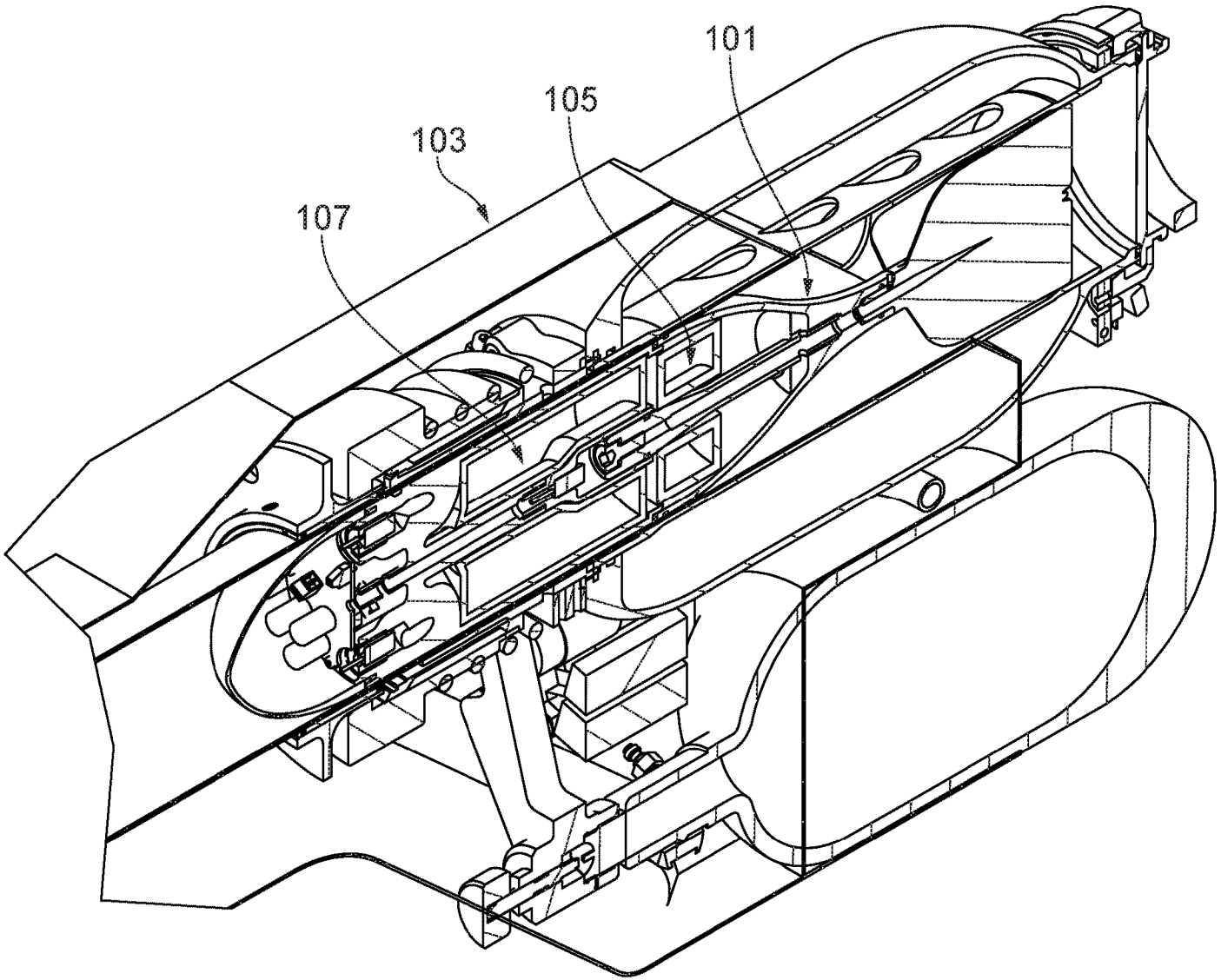
Figure 1C:
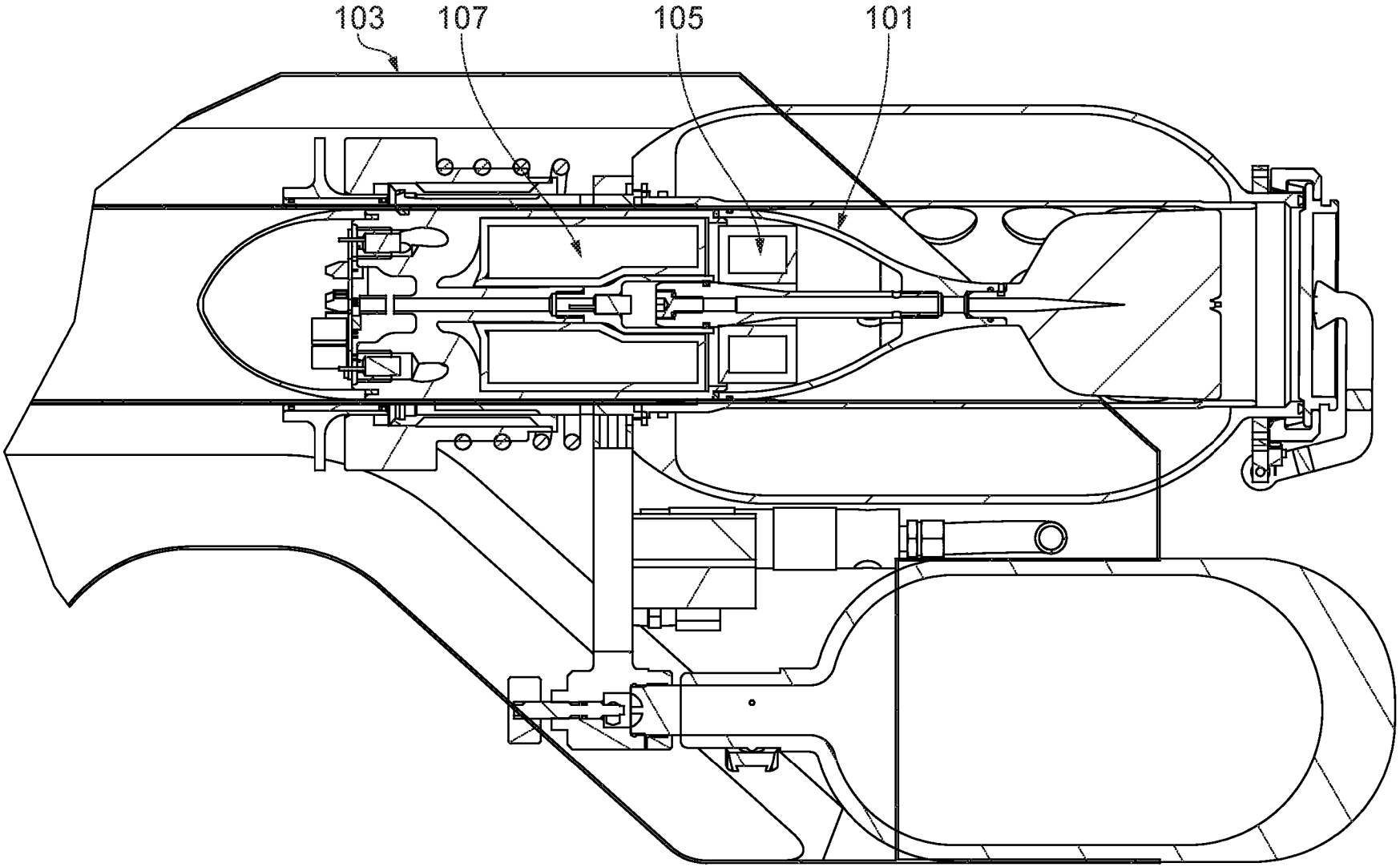

FIGS. 1*a-c* illustrate a system according to an exemplary embodiment of the present invention. FIG. 1*a* is a cross-sectional axonometric view of the system. FIG. 1*b* is a cross-sectional axonometric view of the rear portion of the system. FIG. 1*c* is a cross-sectional side view of the rear part of the system.

This embodiment is described below in relation to disabling, capturing or immobilising an aerial vehicle (for example an aerial drone) using a deployed net. However, the skilled person will appreciate that the present invention is not limited to these specific examples. For example, various embodiments may be used for capturing, immobilising or disabling other types of object, for example land-based or water-based vehicles, and objects other than vehicles (e.g. a person, animal or projectile). In addition, various embodiments may employ a first object other than a net for capturing, immobilising or disabling a second object, for example a manifold of a type other than a net (e.g. a blanket or membrane), or any other suitable means for entangling the moving elements (e.g. rotor blades) of a vehicle, or for otherwise disabling, capturing or immobilising the vehicle.

The system 100 illustrated in FIGS. 1*a-c* comprises (i) a projectile 101, (ii) a launcher 103 for launching or firing the projectile 101, (iii) a net 105, which may be packaged in the projectile 101 and deployed from the projectile 101 during flight, and (iv) a parachute 107, which may also be packaged in the projectile 101 and deployed from the projectile 101 during flight.

Net

The net 105 may comprise any suitable type of netting. The net 105 is adapted for capturing, disabling or immobilising an aerial vehicle by entangling the moving elements (e.g. rotor blades) of the vehicle after the net 105 has been deployed. One example of a net 105 for use in the system 100 of FIGS. 1*a-c* is illustrated in FIG. 2, although the skilled person will appreciate that the present invention is not limited to this specific example.

The skilled person will appreciate that the nets, and features thereof, disclosed herein may be used in applications other than capturing an object by deploying a net from a launched projectile, and may be used in any application requiring a net of the type disclosed herein.

Figure 2:
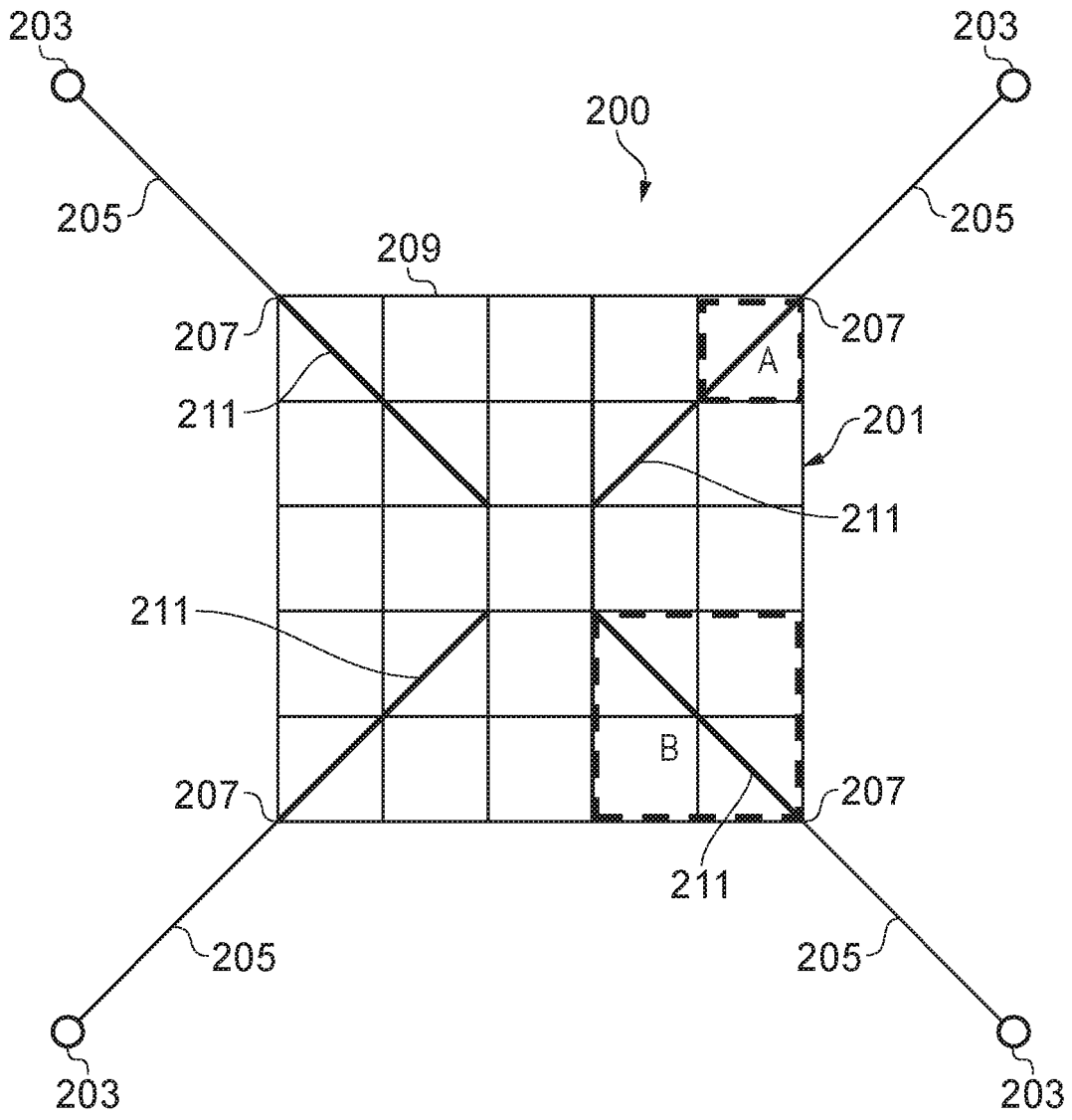
FIG. 2 illustrates an exemplary net for use in the system of FIGS. 1*a-c;*

The net 200 of FIG. 2 comprises a net body 201, a number of weight members 203, and a number of net cords or tethers 205 for connecting respective weight members 205 to respective points 207 on the outer perimeter 209 of the net body 201. Each tether 205 may be formed, for example, from a single line or bundle of lines, or from one or more loops. In certain embodiments, the tethers 205 may be formed from extensions of the material used to form the outer perimeter 209 and/or net pattern of the net body 201. The net cords 205 and weight members 203 are provided to facilitate deployment of the net 200 from the projectile 101. In particular, the weight members 203 are fired from the projectile 101 in divergent directions, thereby causing the net body 201 to expand. Deployment of the net 200 will be described in greater detail further below.

In the embodiment of FIG. 2, the net body 201 is generally square-shaped and comprises a generally square lattice net pattern. In various embodiments, the net pattern may be symmetric or non-symmetric. Four weight members 203*a-d* are provided in this embodiment, which are connected to four respective corners 207*a-d* of the net body 201 by four respective net cords 205*a-d*. The skilled person will appreciate that any other suitable shapes may be used for the net body 201 and/or net pattern, that any suitable number of weight members 203 may be provided, and that the net cords 205*a-d* may be attached to any suitable positions on the outer perimeter 209 of the net body 201, for example including positions other than corners of the net body 201. For example, in one exemplary embodiment, weight members 203 may be attached by net cords 205 to not only to each corner of the net body 201, but also to the mid points of each vertex of the net body 201.

The physical dimensions, form and construction of the various features of the net 200—including, for example, the overall size and shape of the net body 201, the spacing and shape of the net pattern, the lengths of the net cords 205, the weight of the weight members 203, and/or the materials used to construct the various parts of the net 200—may be selected based on one or more design factors—including, for example, the overall size and shape of a target aerial vehicle, the rotor size of the vehicle, net weight constraints, and/or net strength requirements.

For example, according to a first exemplary design criterion, the net body 201 should be sufficiently large, and the net pattern spacing should be sufficiently small, to enable the net 200 to effectively entangle the rotor blades of the target vehicle. For example, in certain embodiments the net body 201 is preferably larger than the vehicle (e.g. if the vehicle is a conventional UAV having a mass less than 20 kg, the net body may be approximately 3×3 metres). According to a second exemplary design criterion, the overall weight of the net 200 should be as low as possible to reduce the force required to launch the projectile 101 while carrying the net 200. A reduction in the overall weight of the net 200 may be achieved, for example by reducing the size of the net body 201 and/or increasing the spacing of the net pattern. According to a third exemplary design criterion, the net 200 should be strong enough to withstand the forces applied to the net 200 during use. The skilled person will appreciate that any additional or alternative design criteria may be used.

In certain embodiments, one or more portions of the net body 201 may be reinforced for increasing the overall strength of the net body 201. When the net body 201 has fully expanded following deployment, the weight members 203 impart relatively large forces on the net as the weight members 203 are stopped. These forces are reacted through the net, primarily around the outer perimeter 209 of the net body 201. Accordingly, in certain embodiments, the net body 201 may comprise a reinforced outer perimeter 209 to prevent the net 200 from breaking. Reinforcing a portion of the net body 201 will tend to increase the overall weight of the net 200. However, by reinforcing only the outer perimeter of the net body 201 a significant increase in overall strength of the net body 201 may be achieved with only a relatively small increase in weight of the net 200. Reinforcement of the outer perimeter 209 may be achieved using a single thread outer loop with a single knot offset from the corners.

In certain embodiments, the net pattern of the net body 201 may further comprise one or more diagonal members 211 for facilitating expansion of the net body 201 following release from the projectile 105. Each diagonal member 211 is made of a flexible, non-elastic material, and the ends of each diagonal member 211 may be attached to diagonally opposite corners of a square (or rectangular) structure of the lattice pattern. Here, the term "square (or rectangular) structure" of the lattice pattern encompasses both a unit square (or rectangle) of the lattice pattern (one example being highlighted in FIG. 2 by dotted square A), and a larger square (or rectangle) formed from an n×m array of unit squares (or rectangles) of the lattice pattern (one example with n=2 being highlighted in FIG. 2 by dotted square B). For example, if each unit square of the net pattern has a side of length L, then the length of a diagonal member 211 attached across a square structure has a length that is an integer multiple of $\sqrt{2}\cdot L$, wherein the multiple depends on the size of the square structure (e.g. n=1 for a unit square). One or more intermediate points (i.e. non-end points) of a diagonal member 211 may be attached to respective intersection points of the net lattice pattern.

A diagonal member 211 may be provided in each corner region of the net body 201 such that one end of each diagonal member 211 is attached to a respective corner 207 of the net body 201, and each diagonal member 211 is arranged so as to extend inwardly in a direction towards a central portion or central region of the net body 201 (e.g. so as to lie on an imaginary line connecting a corner 207 of the net body 201 and the centre point of the net body 201, as illustrated in FIG. 2). In certain embodiments, for example as illustrated in FIG. 2, each diagonal member 211 extends from a corner 207 of the net body 201 to a respective corner of a square structure located at the centre of the net body 201. Each diagonal member 211 may be attached to intersection points of the net lattice pattern along the length of the diagonal member 211.

In certain embodiments, the diagonal members 211 may be formed from extensions of the tethers 205 (or vice versa). In certain embodiments, the diagonal members 211 extending from each corner of the net body 201 do not meet, or are not attached to each other, at any point. In certain embodiments, the diagonal members 211 may be reinforced. The diagonal members may be provided in any suitable symmetric or non-symmetric arrangement.

The skilled person will appreciate that diagonal members 211 may be provided in nets which use a lattice pattern other than a square or rectangular shaped lattice pattern.

Figure 3A:
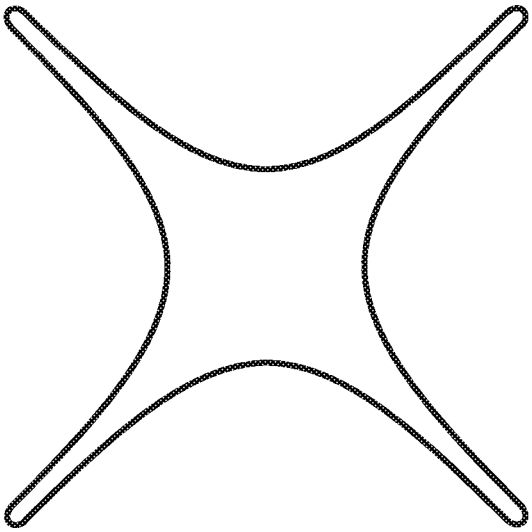
FIGS. 3*a* and 3*b* illustrate the effect of providing diagonal members to the net of FIG. 2.
Figure 3B:
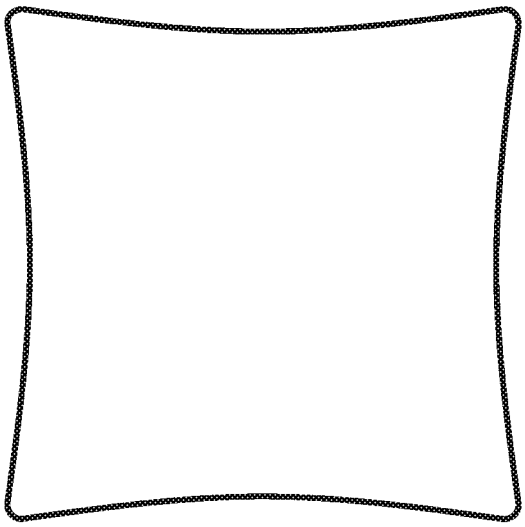

FIGS. 3*a* and 3*b* illustrate the effect of providing diagonal members 211 to the net 200 of FIG. 2. In the case that diagonal members 211 are not provided, when the net 200 is released from the projectile 101, the net body 201 tends to initially form a cross shape (as illustrated in FIG. 3*a*), which is maintained for a relatively long period of time before the net body 201 fully expands to form a generally square shape (as illustrated in FIG. 3*b*). On the other hand, in the case that diagonal members 211 are provided, the diagonal members 211 tend to distribute net forces (e.g. forces applied to the net body 201 by the weight members 203 through the net cords 205 and corners 207 of the net body 201) across the net body 201 in such a way that expansion of the net body 201 from the cross shape of FIG. 3*a* to the generally square shape of FIG. 3*b* occurs more quickly than when no diagonal members 211 are provided.

The diagonal members may also act to reinforce and strengthen the net body 201. Therefore, in certain embodiments, if diagonal members are provided, reinforcement of one or more portions of the net body 201 (e.g. reinforcement of the outer perimeter 209 of the net body 201) may not be necessary.

Various additional features that may be provided for increasing the tangling effectiveness of the net 200 will now be described with reference to FIGS. 4*a-f*. In particular, one or more tangling elements 213 may be attached to the net body 201.

For example, one or more of the tangling elements 213 may comprise a flexible member 213*a* formed from an elongate flexible material such as a streamer, ribbon, chain or string. A flexible member 213*a* may be attached to the net body 201 such that one or more points along the length of the flexible member 213*a* are attached to one or more respective points of the net body 201. In this manner, each flexible member 213*a* forms one or more loops and/or one or more free or loose ends for tangling the rotating elements (e.g. rotor blades) of a target vehicle.

Figure 4A:
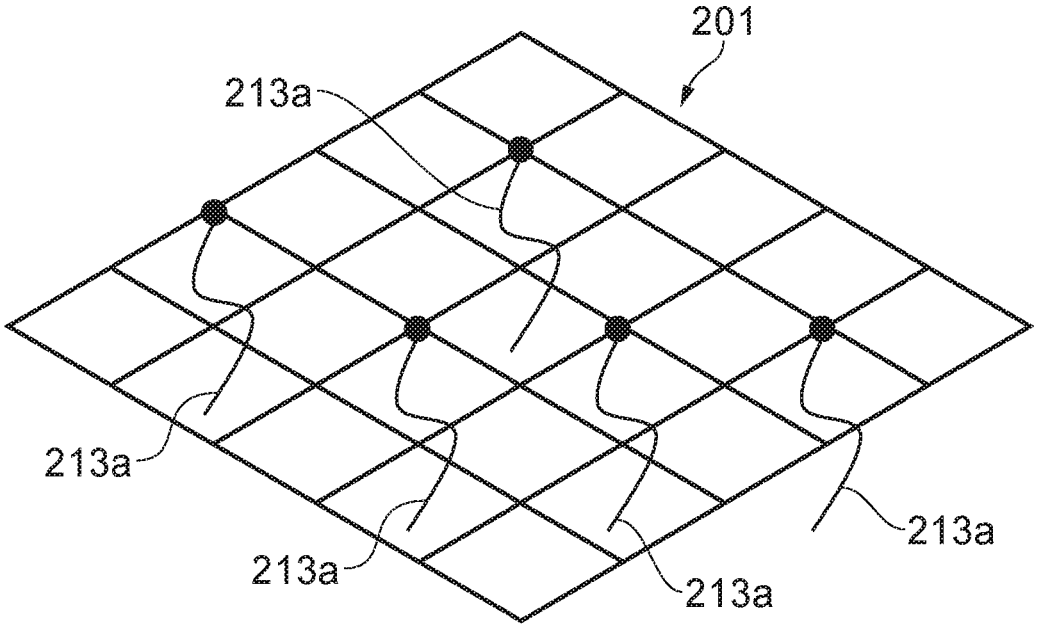
FIGS. 4*a-f* illustrate various additional features for improving the tangling effectiveness of the net of FIG. 2.
Figure 4B:
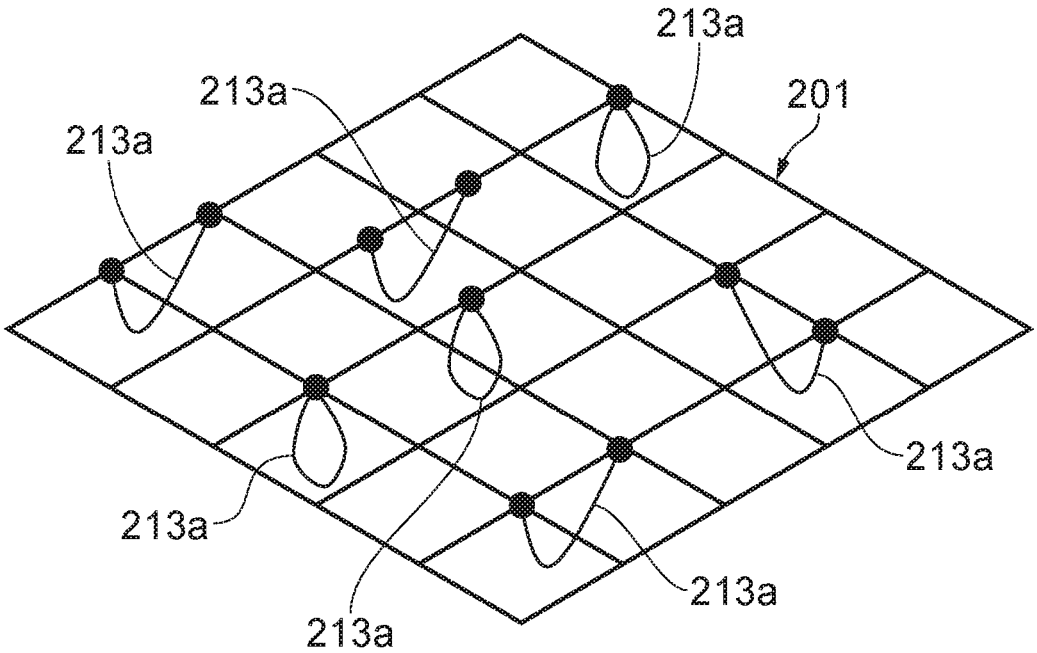
Figure 4C:
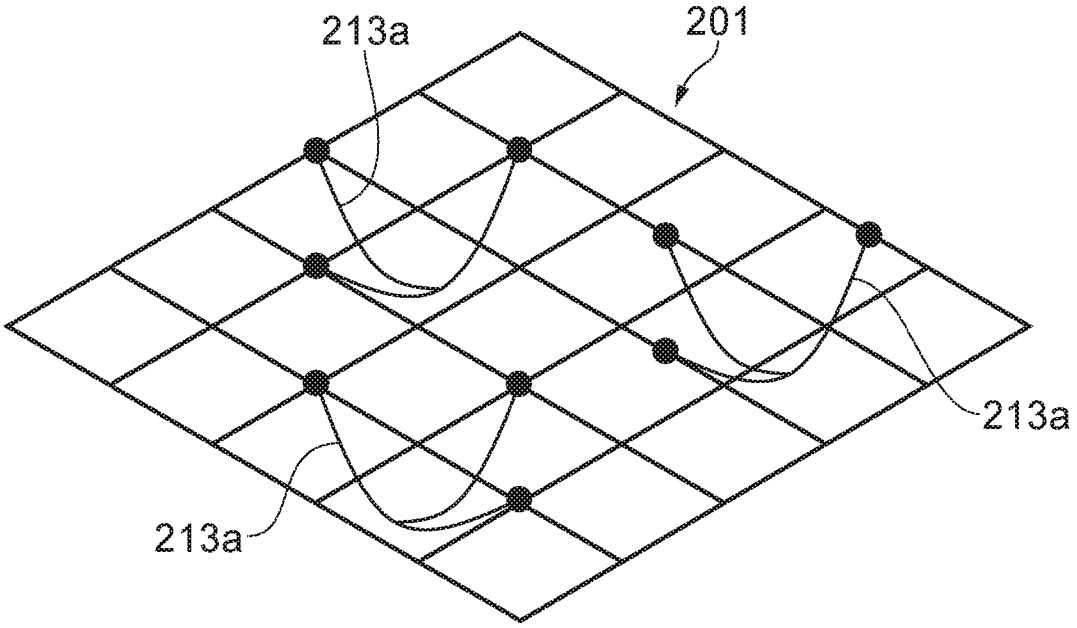
Figure 4D:
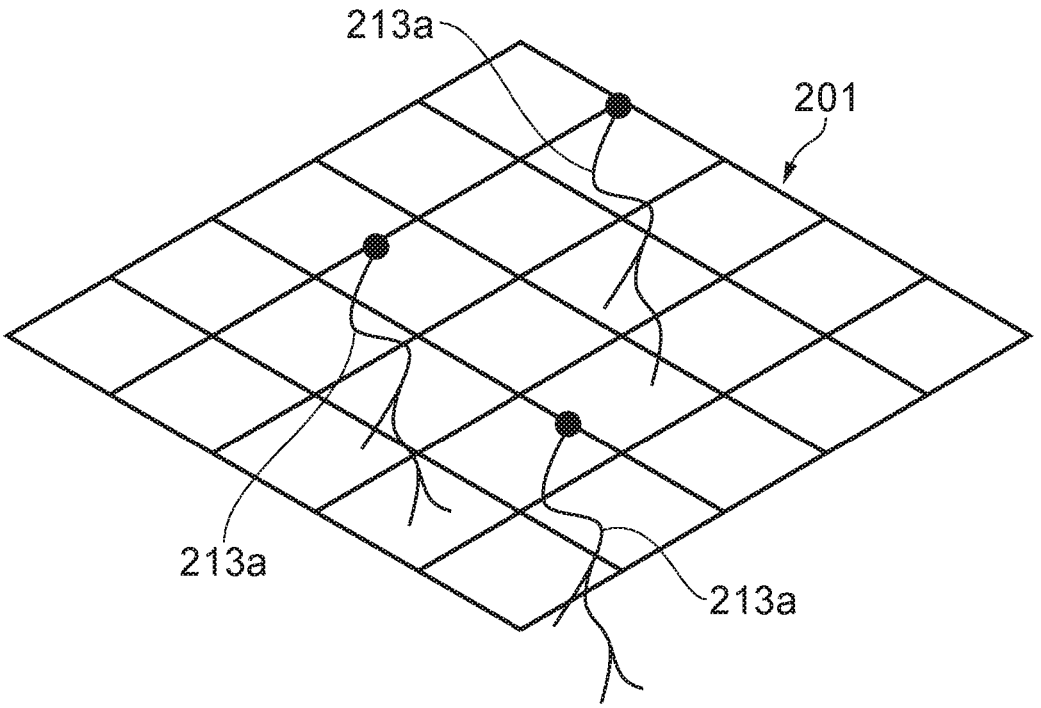

For example, as illustrated in FIG. 4*a*, one end of a two-ended flexible member 213*a* may be attached to the net body 201 at a certain point (e.g. at an intersection point of the net pattern), and the other end of the flexible member 213*a* may be loose, thereby forming a single loose end. In another example, illustrated in FIG. 4*b*, both ends of a two-ended flexible member 213*a* may be attached to the net body 201 (at the same or different points), thereby forming a single loop. In certain embodiments, a flexible member 213*a* may comprise three or more ends. For example, a three or more-ended flexible member 213*a* may be formed by joining two or more two-ended flexible members 213*a* together. For example, as illustrated in FIG. 4*c*, each end of a three-ended flexible member 213*a* may be attached to the net body 201, thereby forming multiple loops. In another example, illustrated in FIG. 4*d*, a flexible member 213*a* comprising three or more ends may be attached to the net body 201 at one end only, thereby forming two or more loose ends. By providing flexible members 213*a* forming multiple loops and/or multiple loose ends, the likelihood of entanglement is increased.

Figure 5A:
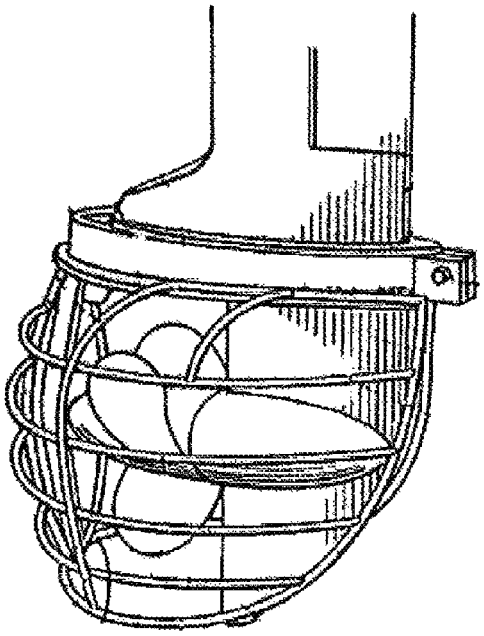
FIGS. 5*a* and 5*b* illustrate aerial vehicles comprising rotor blades that are caged and shrouded.
Figure 5B:
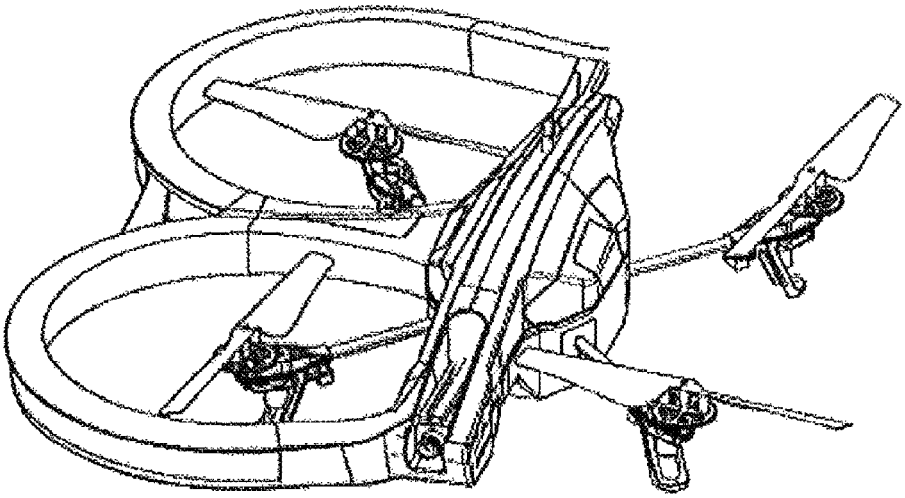

Accordingly, if the net 200 is provided with flexible members 213*a* as described above, when the net 200 is deployed, the flexible members 213*a* tangle the rotating elements of the target vehicle. The provision of flexible members 213*a* may be particularly advantageous in the case that the rotating elements are fully or partially caged, covered, shrouded or otherwise protected, for example as illustrated in FIGS. 5*a* and 5*b*. In this case, a net 200 without flexible members 213*a* may simply hang over a cage, cover or shroud without tangling the rotating elements. On the other hand, flexible members 213*a* of the type described above are able to penetrate the cage, cover or shroud more easily than the net body 201, thereby allowing the flexible members 213*a* to more effectively tangle the rotating elements. Furthermore, the movement of air caused by rotation of the rotating elements will tend to suck the flexible members 213*a* through the cage, cover or shroud towards the rotating elements, thereby increasing the likelihood of entanglement.

Figure 4E:
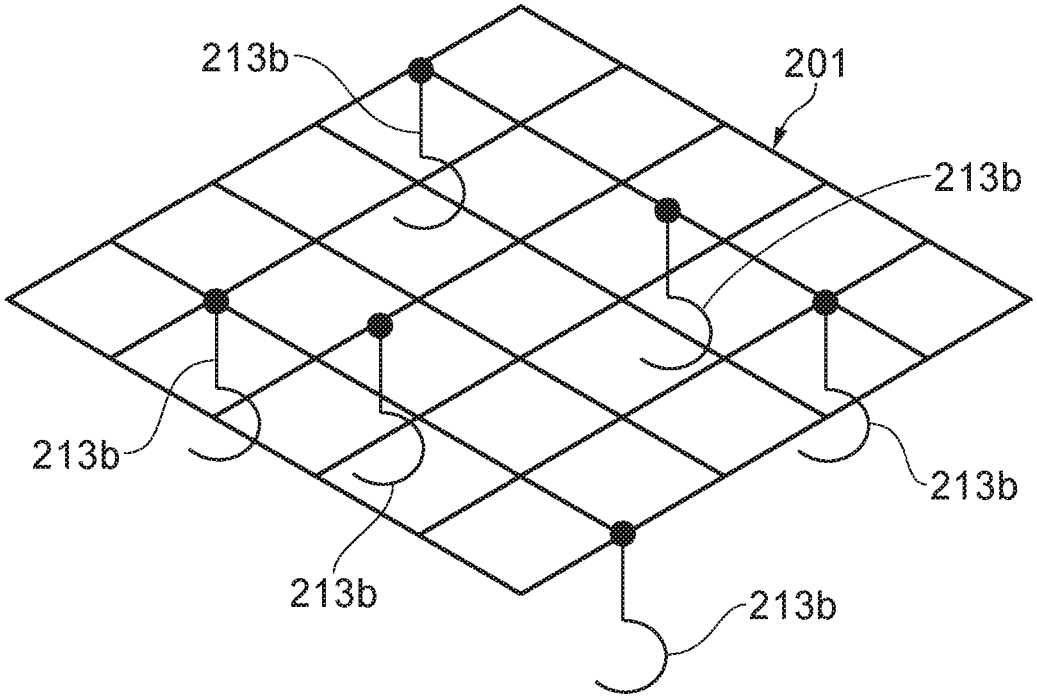

When the net 200 is deployed, there is a chance that the net 200 will simply slip or slide off the target vehicle without tangling the rotating elements. The likelihood of such an occurrence is greater in the case that the rotating elements are fully or partially caged, covered, shrouded or otherwise protected, for example as illustrated in FIGS. 5*a* and 5*b*. Accordingly, as illustrated in FIG. 4*e*, one or more of the tangling elements 213 may comprise a hook member 213*b* formed from an elongate non-flexible material such as metal. The hook members 213*b* may be attached to the net body 201 at any suitable positions and are configured for hooking the net body 201 to the target vehicle or a part thereof (e.g. the cage, cover or shroud of rotating elements). Accordingly, the hook members 213*b* help to keep the net body 201 attached to the target vehicle, thereby increasing the likelihood of entanglement.

The tangling elements 213 may be disposed on the net body 201 in any suitable arrangement. For example, the tangling elements 213 may be arranged in a regular or symmetric pattern over the net body 201 to facilitate manufacture. Alternatively, the tangling elements 213 may be arranged in an irregular or random manner over the net body 201.

The arrangement of the tangling elements 213 may be adapted according to known design features of the target vehicle. For example, the arrangement pattern of tangling elements 213 may be configured to match a pattern of openings in the cage, cover or shroud of the target vehicle. For example, if a cage of the target vehicle is known to have a square pattern, the tangling elements 213 may be arranged in a square pattern, and if the cage has a hexagonal pattern, the tangling elements 213 may be arranged in a hexagonal pattern. In addition, the spacing or pitch of the tangling elements 213 may be selected to be an integer divisor or integer multiple of the spacing or pitch of the openings in the cage, cover or shroud. For example, if the cage of the target vehicle is known to have openings with a spacing of 10 mm, the tangling elements 213 may be arranged to have a spacing of 10 mm, 5 mm, 3.33 mm, 2.5 mm, etc., or 10 mm, 20 mm, 30 mm, etc. By arranging the tangling elements 213 in the manner described above, the likelihood of entanglement may be increased.

If certain design features of the target vehicle (e.g. the pattern or pitch of the cage openings) are unknown, then it may be advantageous to arrange the tangling elements 213 in an irregular or random manner, for example to reduce the number of tangling elements 213 required to achieve an acceptable likelihood of entanglement, thereby reducing the overall weight and volume of the net 200. For example, the tangling elements 213 may be arranged with relative spacings that are ratios of prime numbers. This arrangement increases the likelihood that a particular tangling element 213 will be located at an opening of the cage, cover or shroud of the rotating elements of the target vehicle.

Figure 4F:
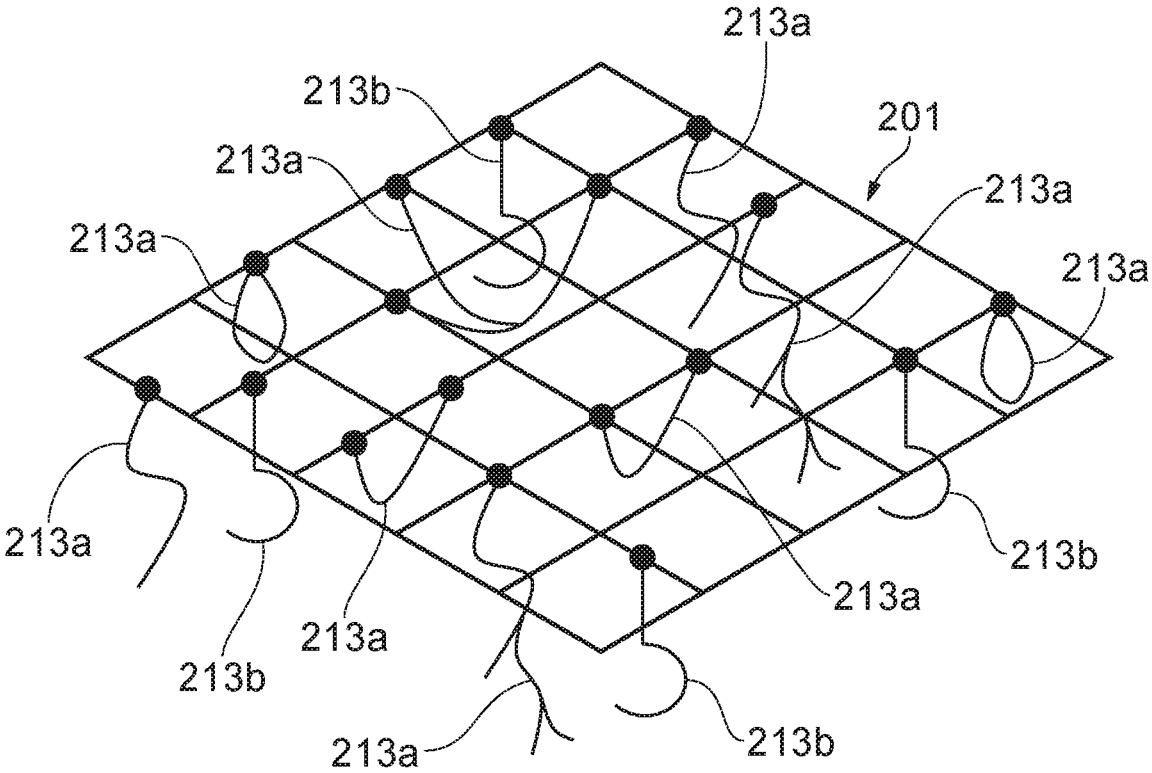

The skilled person will appreciate that the various types of tangling elements 213 described above may be used individually or in any combination. For example, the net body 201 may be provided with flexible elements only, hook elements only or both flexible elements and hook elements. One example is illustrated in FIG. 4*f*.

Projectile

The projectile 101 of FIGS. 1*a-c* may comprise any suitable type of projectile for holding or carrying the net 105 and for deploying the net 105 after launch. One example of a projectile 101 for use in the system 100 of FIGS. 1*a-c* is illustrated in FIGS. 6*a-i*, although the skilled person will appreciate that the present invention is not limited to this specific example.

Figure 6A:
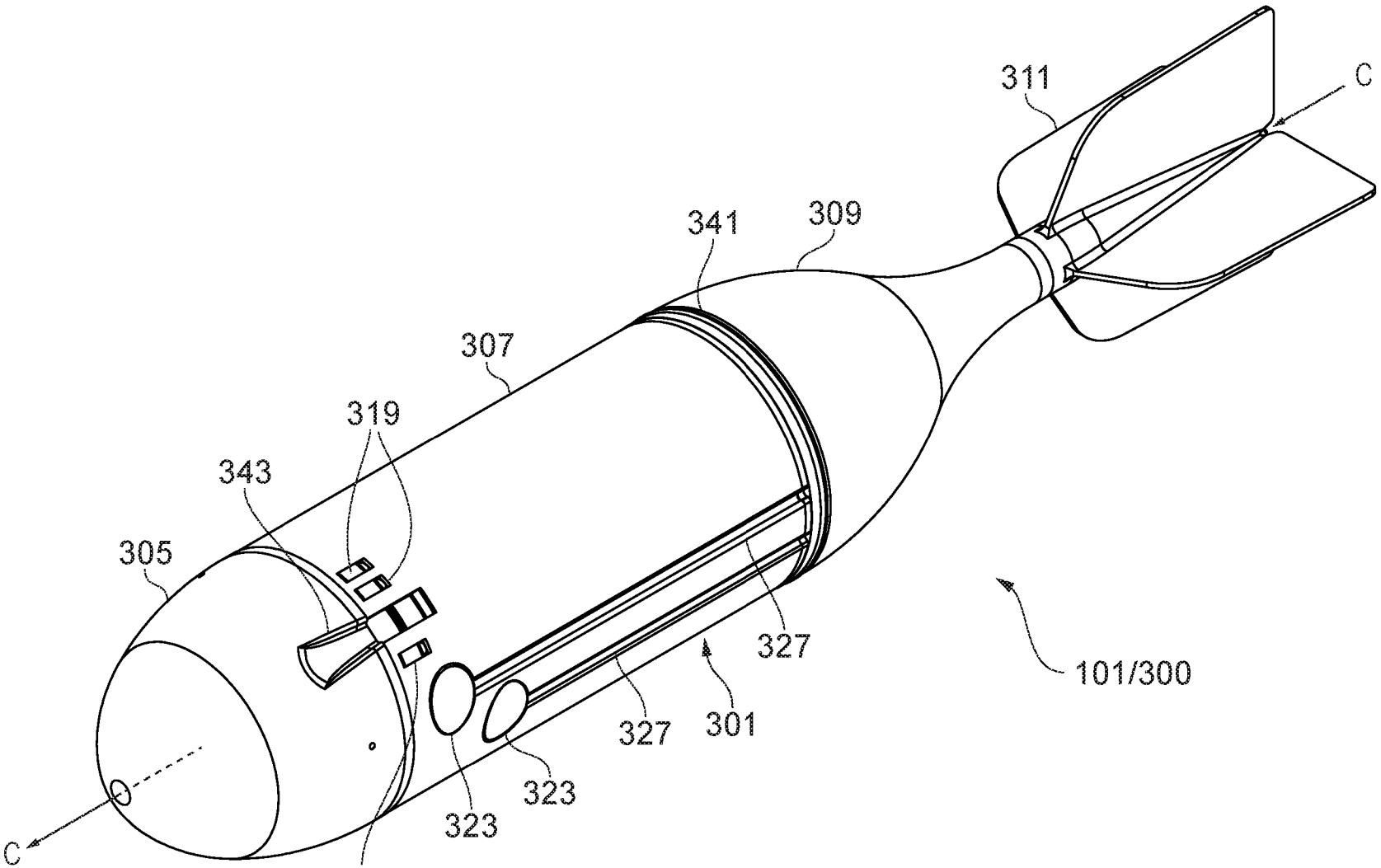
FIGS. 6*a-i* illustrate an exemplary projectile for use in the system of FIGS. 1*a-c;*
Figure 6B:
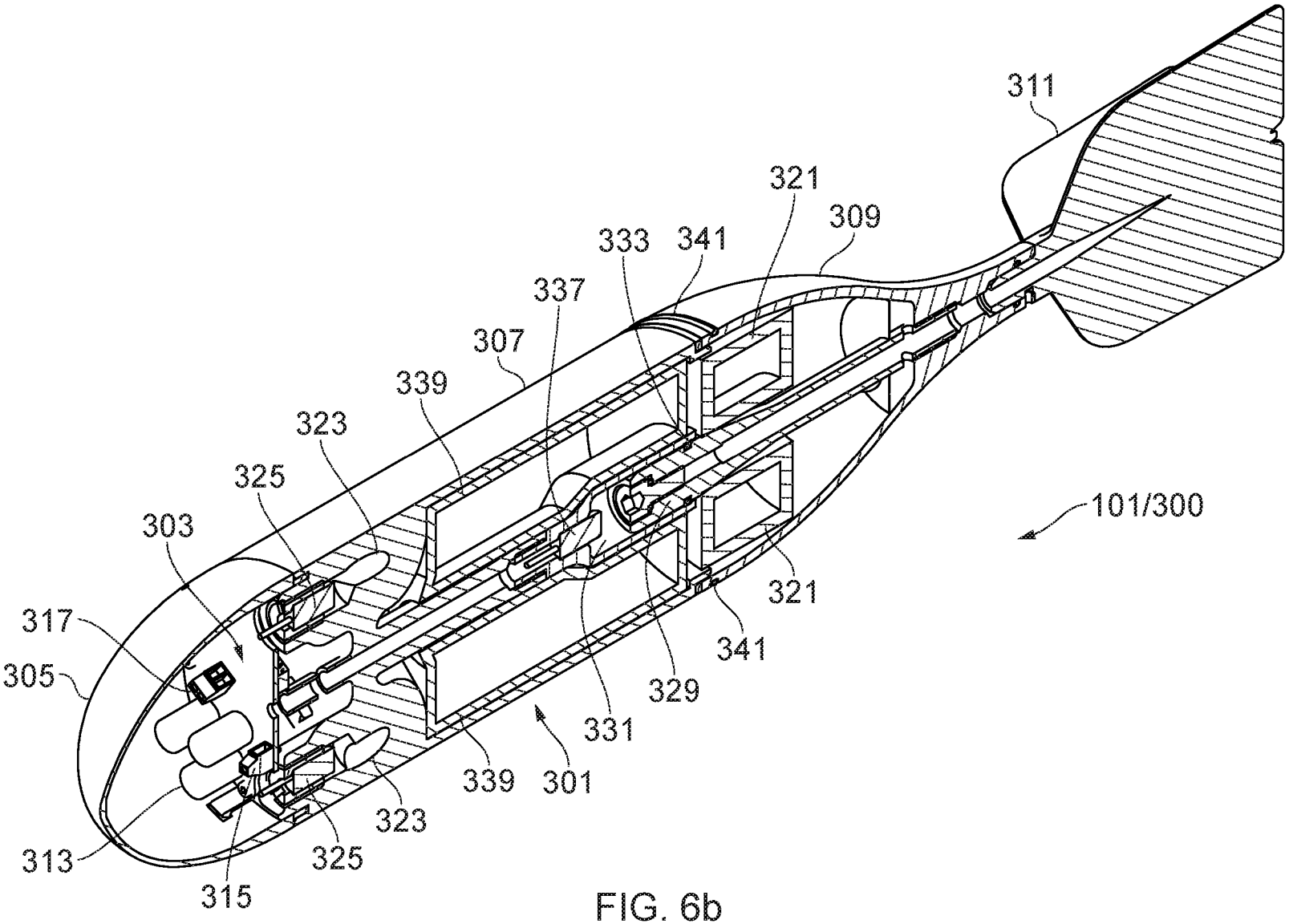
Figure 6D:
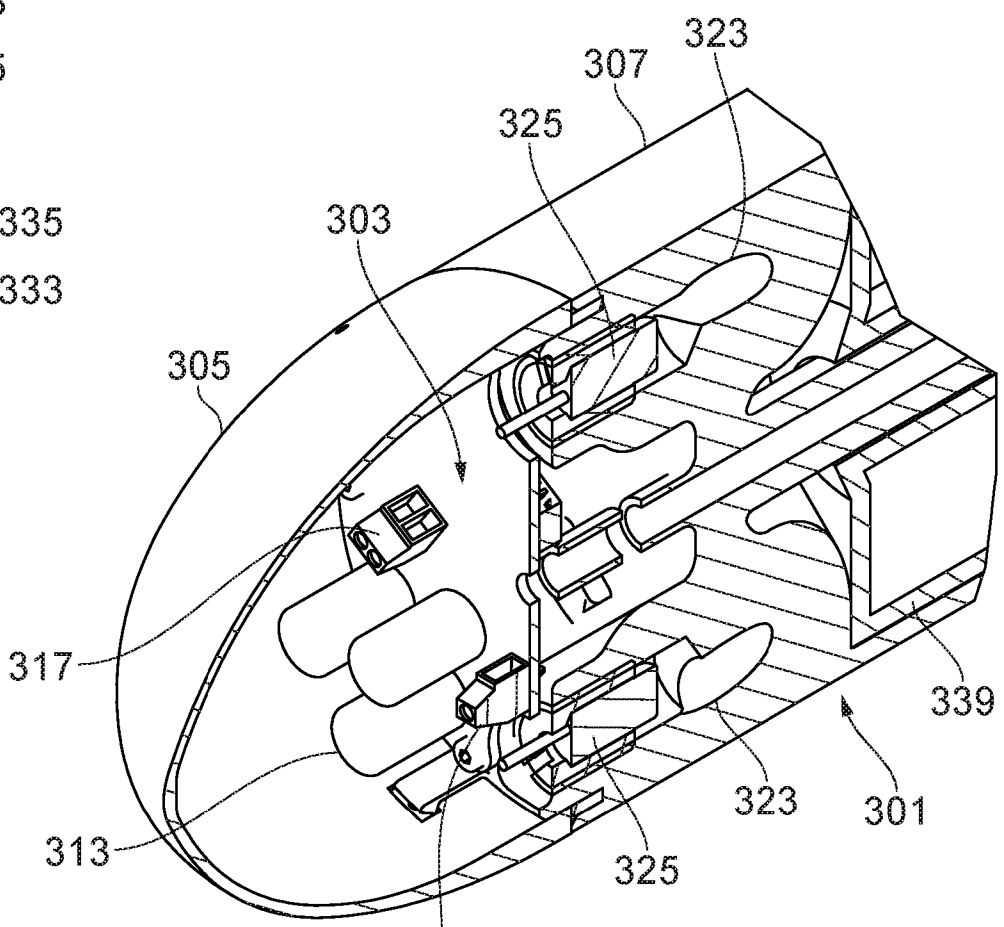
Figure 6C:
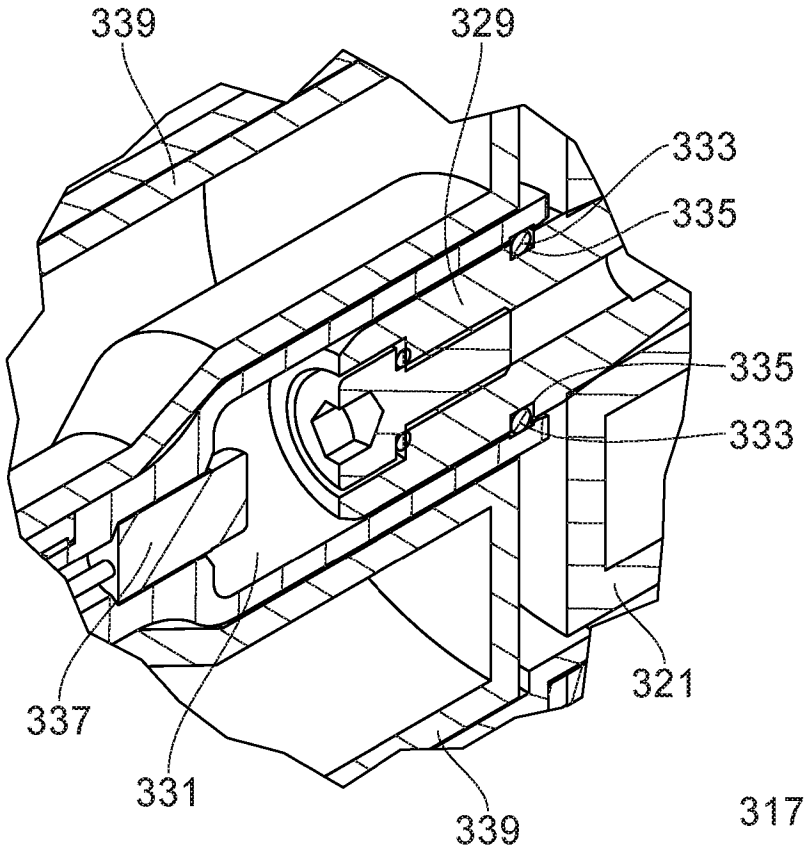
Figure 6E:
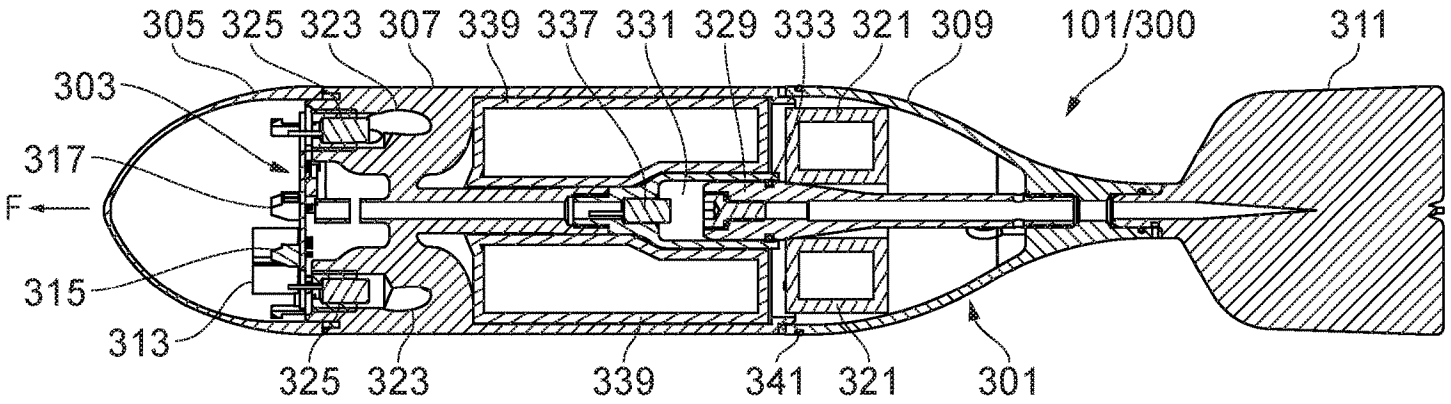
Figure 6G:
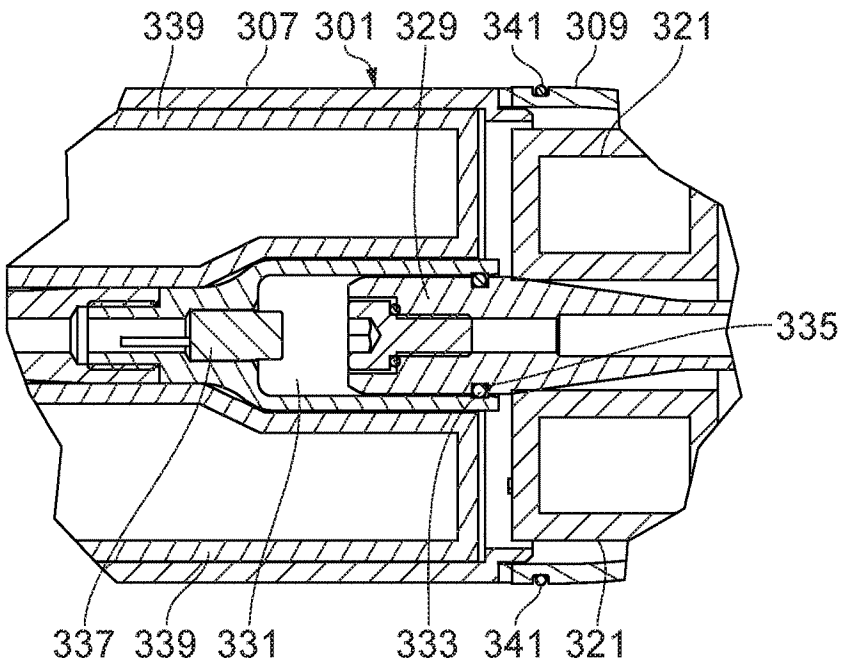
Figure 6F:
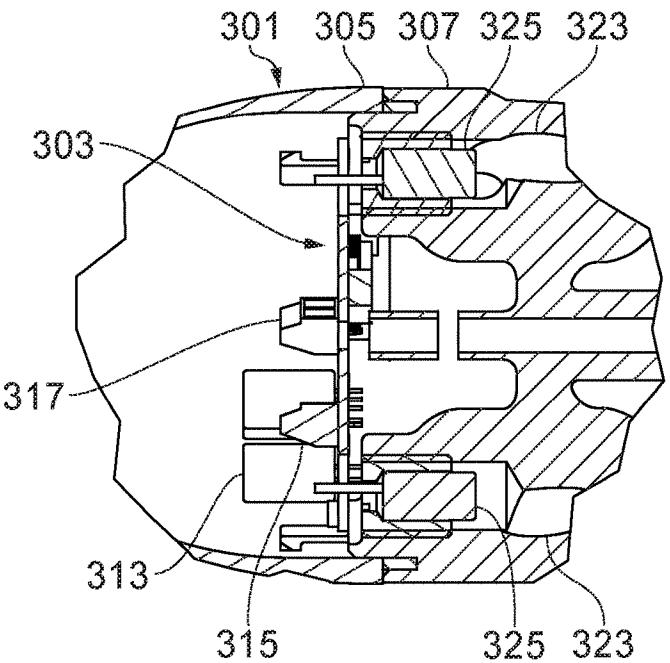
Figure 6H:
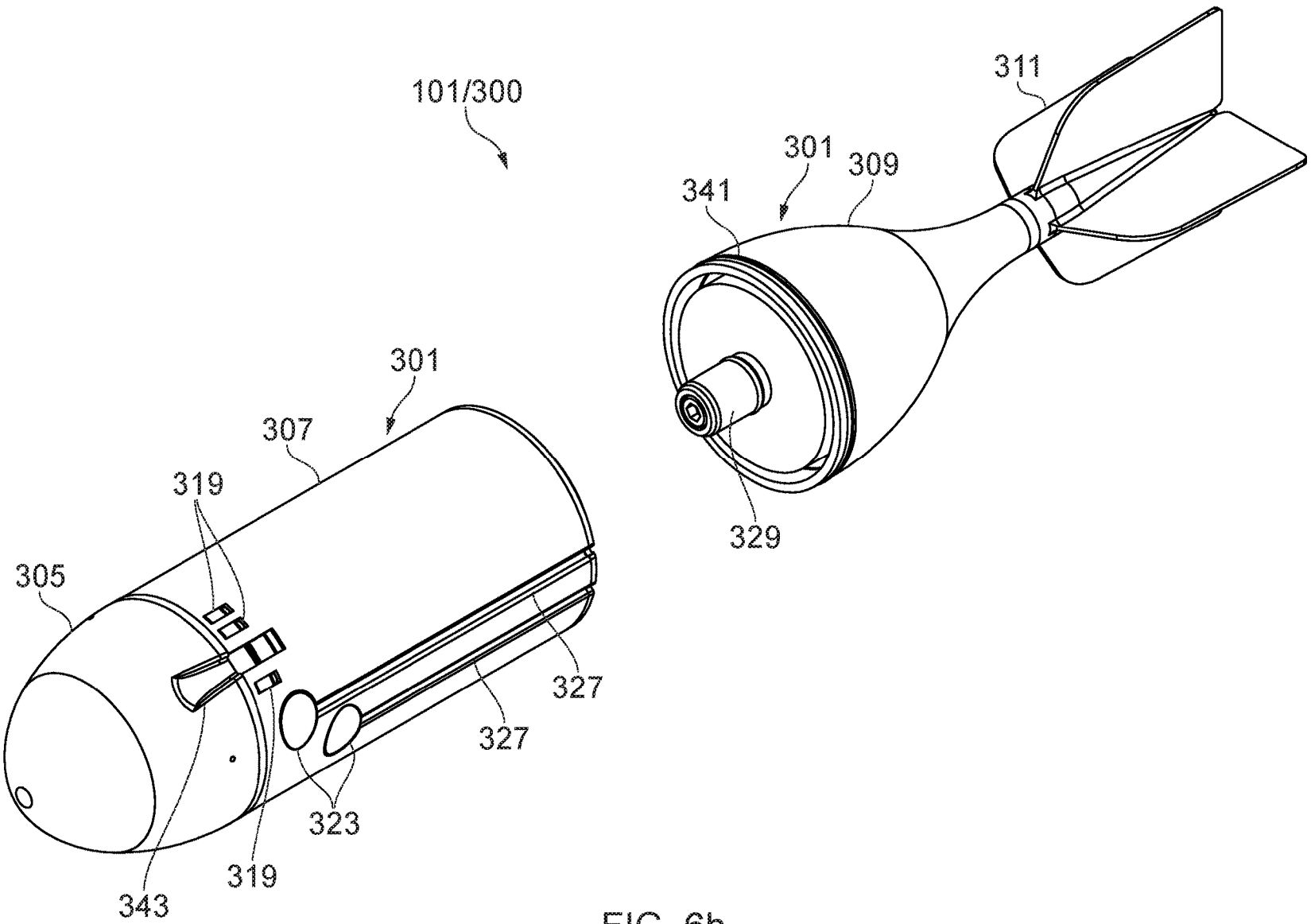
Figure 6I:
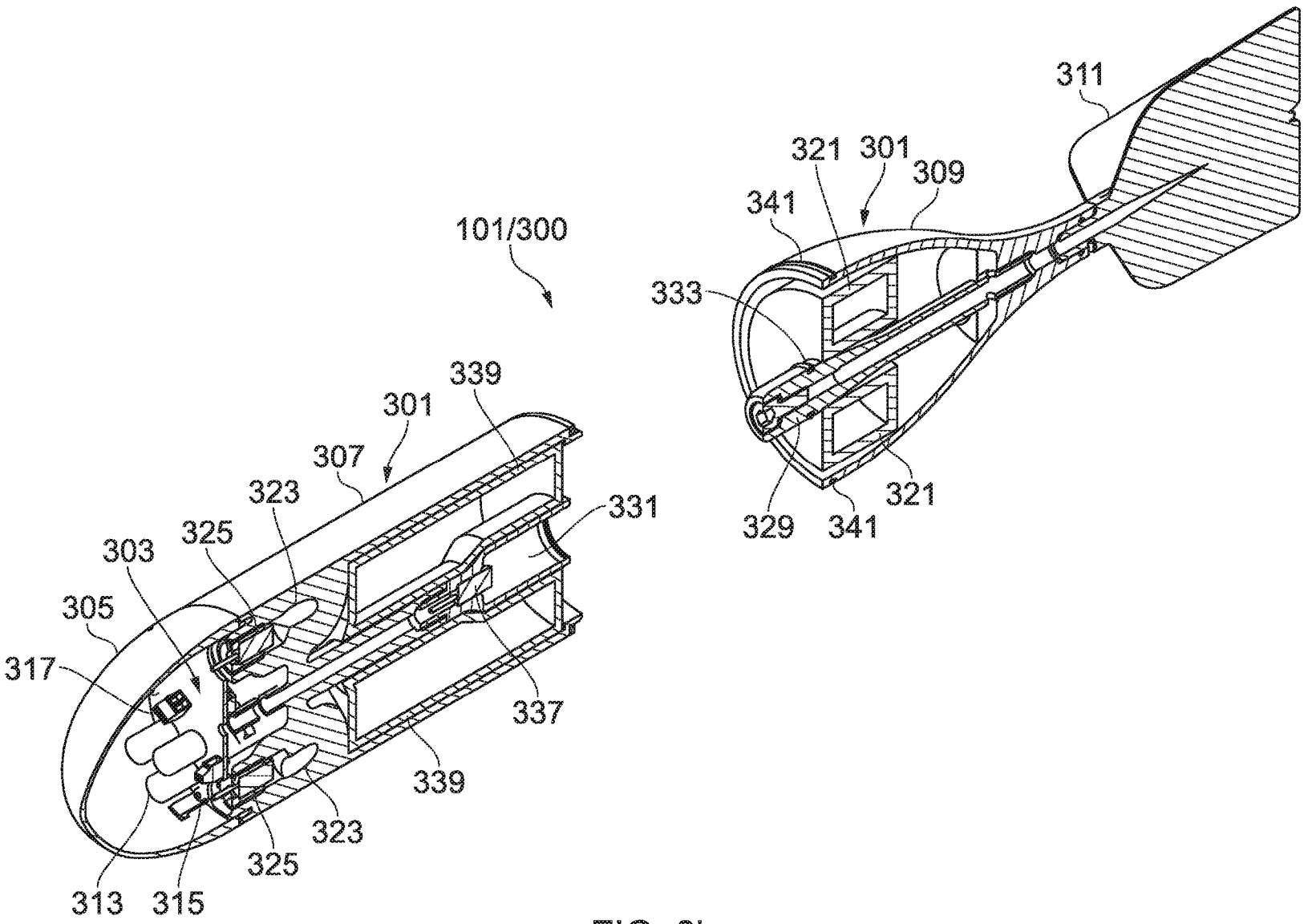

FIG. 6*a* is an external axonometric view of the projectile 101. FIG. 6*b* is a cross-sectional axonometric view of the projectile 101. FIGS. 6*c* and 6*d* are cross-sectional axonometric views illustrating a middle portion and a front portion of the projectile 101 magnified relative to FIG. 6*b*. FIG. 6*e* is a cross-sectional side view of the projectile 101. FIGS. 6*f* and 6*g* are cross-sectional side views illustrating a front portion and a middle portion of the projectile 101 magnified relative to FIG. 6*e*. FIG. 6*h* is an external axonometric view of the projectile 101 when separated. FIG. 6*i* is a cross-sectional axonometric view of the projectile 101 when separated.

In the following description, the terms "front" and "back" or "rear" refer to directions, positions and/or ends with reference to the direction of flight of the projectile 101 (indicated as arrow F in FIG. 6*e*). That is, the front end of the projectile 101 is located at the left hand side of FIG. 6*e*, and the back or rear end of the projectile 101 is located at the right hand side of FIG. 6*e*. A front surface of a component refers to a surface facing towards the front end of the projectile 101, and a back or rear surface of a component refers to a surface facing towards the rear end of the projectile 101. In addition, a central axis of the projectile 101, parallel to the direction of flight F, is indicated as axis C in FIG. 6*a*.

The projectile 300 of FIGS. 6*a-i* comprises a case 301 into which the net 105 and the parachute 107 (not shown in FIGS. 6*a-i*) may be packaged. The case 301 also contains a mechanism for deploying the net 105 during flight, a mechanism for releasing the parachute 107 during flight, and control circuitry 303 for controlling deployment of the net 105 and release of the parachute 107.

The case 301 is provided in the form of an elongate casing comprising a front nose section 305, a generally cylindrical middle body section 307, and a rear tail section 309. The nose section 305 may be suitably shaped to reduce aerodynamic drag on the projectile 300 during flight. The tail section 309 may comprise a number of flights or tail pieces 311 for improving aerodynamic stability of the projectile 300 during flight.

The case 301 is configured to be separable into at least two pieces during flight, to open the casing and enable the net 105 to be deployed and the parachute 107 to be released. In the embodiment of FIGS. 6*a-i*, a first piece comprises the nose section 305 and the body section 307 (which may be permanently joined in any suitable manner to form a single piece, or may be formed integrally), and a second piece comprises the tail section 309.

The skilled person will appreciate that the manner in which the projectile 101 is separated for deploying the net 105 and releasing the parachute 107 is not limited to the specific example shown in FIGS. 6*a-i*. For example, depending on where the net 105 and parachute 107 are packaged in the case 301, different sections of the case 301 may separate. For example, in various embodiments, the body section 307 and the tail section 309 may separate (e.g. if at least one of the net 105 and the parachute 107 is packaged in the tail section 309 or the rear of the body section 307), and/or the nose section 305 and the body section 307 may separate (e.g. if at least one of the net 105 and the parachute 107 is packaged in the nose section 305 or the front of the body section 307). The skilled person will appreciate that the net 105 and the parachute 107 may be packaged in any suitable locations within the projectile 101. For example, the parachute 107 may be packed in the body section 307 and the net 105 may be packaged in the tail section 309, or vice versa.

In yet further embodiments, the case 301 may be opened to deploy the net 105 and release the parachute 107 without completely separating parts of the case 301. For example, in certain embodiments, one or more doors, panels, hatches or the like provided in the case 301 may be opened or released to deploy the net 105 and release the parachute 107. In some embodiments, the nose section 305 may comprise an arrangement of two or more petalled panels, which may be opened, separated or released to open the nose section 305.

In certain embodiments, the separable pieces of the projectile 300 may be loosely connected by one or more tethers (not shown in FIGS. 6*a-i*). This arrangement ensures that the separated pieces of the projectile 101 remain together, thereby avoiding dispersion or scattering of the pieces following separation.

The body section 307 comprises a parachute compartment 339 in which the parachute 107 may be packaged. For example, the parachute compartment 339 may comprise a specific container provided inside the projectile 101, or may be formed by a vacant space within the projectile case 301. In the embodiment of FIGS. 6*a-i*, the parachute compartment 339 is generally annular and extends around the central axis C of the projectile 300. The parachute compartment 339 is formed at the rear portion of the body section 307 such that when the body section 307 and the tail section 309 are connected, the parachute compartment 339 is closed, and when the body section 307 and the tail section 309 become separated, the parachute compartment 339 opens enabling the packaged parachute 107 to be released.

In the Figures, the parachute compartment 339 is illustrated as having a closed rear surface or wall, which may be formed, for example, by a cap, plug or seal. During use, the cap or plug may be pushed out, or the seal may be broken, to open the parachute compartment 339, by the action of the parachute 107 being pulled out of the parachute compartment 339 following separation of the projectile 300. In alternative embodiments, the rear surface or wall of the parachute compartment 339 may be omitted, so that the parachute compartment 339 is opened as a direct result of separation of the projectile 300.

The tail section 309 comprises a net compartment 321 in which the net body 201 of the net 105 may be packaged. For example, the net compartment 321 may comprise a specific container provided inside the projectile 101, or may be formed by a vacant space within the projectile case 301. In the embodiment of FIGS. 6*a-i*, the net compartment 321 is generally annular and extends around the central axis C of the projectile 300. The net compartment 321 is formed at the front portion of the tail section 309 such that when the body section 307 and the tail section 309 are connected, the net compartment 321 is closed, and when the body section 307 and the tail section 309 become separated, the net compartment 321 opens enabling the packaged net 105 to be deployed.

In the Figures, the net compartment 321 is illustrated as having a closed front surface or wall, which may be formed, for example, by a cap, plug or seal. During use, the cap or plug may be pushed out, or the seal may be broken, to open the net compartment 321, by the action of the net body 201 being pulled out of the net compartment 321 by the weight members 203 and net cords 205 following separation of the projectile 300. In alternative embodiments, the front surface or wall of the net compartment 321 may be omitted, so that the net compartment 321 is opened as a direct result of separation of the projectile 300.

The skilled person will appreciate that the net 105 and the parachute 107 may be packaged in other locations within the case 301. For example, in certain embodiments, the net 105 may be packaged in the front portion of the body section 307 instead of the front portion of the tail section 309. In certain embodiments, the parachute 107 may be packaged in the nose section 305 instead of the body section 307. In certain embodiments, the parachute 107 may be packaged in the same section (e.g. the tail section 309 or the body section 307) as the net 105.

A seal member 341, for example in the form of an O-ring, is provided around the external circumference of the projectile 101 adjacent to the join between the body section 307 and the tail section 309. The seal member 341 is provided to help form an airtight seal when the projectile 101 is loaded in the launcher 103 as part of the mechanism for launching the projectile 101, which will be described further below.

Projectile Control Circuitry

In the embodiment of FIGS. 6*a-i* the nose section 301 of the projectile 300 houses the control circuitry 303, although the skilled person will appreciate that the control circuitry 303 may be disposed in any other suitable part of the projectile 300. The control circuitry 303 comprises a power source 313 for powering the control circuitry 303 and electrical components of the net deployment mechanism, a timer 315 for controlling the timing of the net deployment mechanism, and a processor 317 for controlling overall operation of the control circuitry 303, including controlling net deployment.

One or more electrical contacts 319 are provided on the exterior surface of the projectile 101 (e.g. the front end of the body section 307). The contacts 319 are electrically connected to inputs of the control circuitry 303 and provide an external interface for the control circuitry 303. In particular, the contacts 319 are arranged to connect with a corresponding set of contacts provided in the launcher 103 when the projectile 101 is loaded into the launcher 103. In this way, the launcher 103 may charge the power source 313, program the timer 315, and trigger the timer 315 by outputting a charging signal, a program signal, and a trigger signal, respectively, to appropriate contacts 319.

In certain embodiments, one or more of the signals (e.g. the program signal and/or the trigger signal) may be transmitted from the launcher 103 to the projectile 101 without using electrical contacts, for example wirelessly (e.g. using Near Field Communication, NFC). In this case, one or more of the contacts 319 may be omitted and the projectile 101 may be provided with a wireless communication module. Furthermore, in this case, the signals may be transmitted to the projectile 101 either before or after launch of the projectile 101.

The power source 313 may comprise any suitable source of power, for example a battery (either rechargeable or non-rechargeable). In certain embodiments, the power source 313 may comprise one or more capacitors of sufficiently high capacitance (e.g. super capacitor), which may be charged to store electrical energy and subsequently discharged to supply power.

The power source 313 may be configured such that the power source 313 is left in a substantially discharged state following single use of the projectile 101 (e.g. after a single projectile launch and net deployment cycle). For example, the power source 313 may be configured for storing enough energy for single use but not enough energy for two or more uses. Alternatively or additionally, the power source 313 may be configured for storing power for only a limited time period after being charged (e.g. by spontaneously discharging any power remaining after the time period has expired). For example, the time period may be set to be slightly longer than a typical time period for completing a projectile launch and net deployment cycle.

In certain embodiments, the power source 313 becomes charged only when the projectile 101 is loaded into the launcher and ready for launch, rendering the projectile 101 inert prior to launch. Furthermore, the power source 313 becomes discharged after the projectile has been launched, once again rendering the projectile inert. While the projectile 101 is inert, the likelihood of accidental deployment of the net 105 is small. Accordingly, the projectile 101 is rendered safe for handling during use (e.g. while being loading), and when not in use (e.g. during storage or transportation). Furthermore, if net deployment fails after the projectile 101 is launched, the projectile 101 is quickly rendered inert, thereby minimising the danger to any member of the public who might handle the projectile 101 after it has landed.

The timer 315, for example a Programmable Interval Timer (PIT), is configured to output a timer signal a programmed time interval after receiving an input trigger signal. The time interval may be programmed based on a program signal received through one of the contacts 319, and the trigger signal may be received through another one of the contacts 319. The trigger signal and/or the program signal received through the contacts 319 may be provided to the timer 315 directly. Alternatively, the trigger signal and/or the program signal may be provided to the processor 317, which then forwards the signals to the timer 315. Deployment of the net 105 may be initiated by the processor 319 in response to the timer signal output by the timer 315.

Projectile Separation Mechanism

An exemplary mechanism for separating the body section 307 from the tail section 309, to enable the net 105 to be deployed and the parachute 107 to be released, will now be described.

The tail section 309 comprises a projection or shaft 329 extending forwardly from the central portion of the front surface of the tail section 309. The body section 307 comprises a corresponding recess 331 extending forwardly from the central portion of the rear surface of the body section 307. The projection 329 and corresponding recess 311 are arranged such that when the projectile 300 is assembled the projection 329 mates with the recess 331. The outer diameter of the projection 329 is substantially the same as the inner diameter of the recess 331. Accordingly, when the projectile 300 is assembled, the projection 329 and corresponding recess 331 form a close fitting mating connection. However, during separation, the projection 229 should be able to slide out of the recess 331 with relatively little resistance.

A securing member 333 is provided in the body section 307 to prevent the body section 307 and the tail section 309 from separating until a desired point in time. In the embodiment of FIGS. 6*a-i*, the securing member 333 comprises a canted spring disposed in an annular space 335 formed by a first groove extending around the outer circumference of the projection 329 and a corresponding second groove extending around the inner circumference of the recess 331 and facing the first groove. The sizes of the canted spring 333 and the annular space 335 are chosen such that the canted spring 333 is at least partially compressed when disposed in the annular space 335. With this arrangement, any force tending to separate the body section 307 and the tail section 309 (i.e. any force tending to pull the projection 329 out of the recess 331) is resisted by the canted spring 333 up to a relatively predictable separation force threshold.

The depth of the recess 331 is larger than the length of the projection 329. Accordingly, when the projectile 300 is fully assembled, a closed volume of known size (referred to below as a "dead volume") is formed between the forward end of the projection 329 and the rear surface of the recess 331.

A component 337 for providing an expansion force or separation force is disposed at least partly within the dead volume. In the embodiment of FIGS. 6*a-i*, the component 337 comprises a squib or gas generator disposed at the inner end of the recess 331. The squib 337 is configured to be activated by an activation signal generated by the control circuitry 303. When activated, the squib 337 causes a rapid build-up of pressure within the dead volume thereby producing a separation force that tends to urge the projection 329 out of the recess 331. In particular, the squib 337 is configured to produce a separation force that is higher than the separation force threshold of the canted spring 333. Accordingly, when the squib 337 is activated, the tail section 309 becomes separated from the body section 307, causing the net compartment 321 and the parachute compartment 339 to open, thereby allowing the net 105 to be deployed and the parachute 107 to be released.

The skilled person will appreciate that the securing member 333 is not limited to the example of a canted spring disposed in an annular groove. The securing member 333 may comprise any element capable of preventing the body section 307 and the tail section 309 from separating until a desired point of time. For example, in other embodiments the securing member 333 may comprise an O-ring, a shear pin, or a mechanical fuse wire.

The skilled person will appreciate that the dead volume may be formed in configurations other than those described above. For example, in other embodiments, the recess may be formed in the tail section 309 and the projection 329 may be formed as part of the body section 307. In further embodiments the projection 329 may be omitted. In yet further embodiments, the dead volume may be formed partly within the body section 307 and partly within the tail section 309, or any other suitable parts of the projectile body.

The skilled person will also appreciate that the present invention is not limited to the use of a squib. For example, in certain embodiments the projectile 300 comprises a releasable latch for preventing separation of the body section 307 and the tail section 309, and a spring for providing a separation force. When the projectile 300 is fully assembled, the latch is closed and the spring is maintained in a compressed state. When the latch is released (e.g. under control of the control circuitry 303), a force exerted by the compressed spring urges the body section 307 and the tail section 309 apart.

In the embodiment described above, a single projection 329 and recess 331 are provided. However, in other embodiments, two or more projections 329 and corresponding recesses 331 may be provided.

Parachute Release Mechanism

The parachute 107 is packaged in the parachute compartment 339. The parachute 107 may be connected to the tail section 309 by one or more tethers having lengths such that when the tail section 309 separates from the body section 307 in the manner described above, the tail section 309 pulls the tethers, which in turn pull the parachute 107 out of the parachute compartment 339. With this arrangement, the separation of the body section 307 and the tail section 309 is used to release the parachute 107. Accordingly, a separate mechanism for releasing the parachute 107 is not required.

In certain exemplary embodiments, a tube may be disposed inside the parachute compartment 339 so as to surround the central portion of the body section 307 (e.g. including the recess 331), to assist release of the parachute 107 from the parachute compartment 339. The tube may extend along the entire length of the parachute compartment 339. The tube may have a close-fitting relationship to the central portion of the body section 307 and have a relatively smooth inner surface to enable the tube to slide off the central portion of the body section 307 relatively easily when the body section 307 has separated from the tail section 309. The parachute 107 is packaged inside the parachute compartment 339 outside the tube. With this arrangement, when the parachute 107 is released, the tube slides out of the parachute compartment 339 together with the parachute 107. Since the tube has a relatively smooth inner surface, release of the parachute 107 is facilitated and snagging of the parachute 107 on the central portion of the body section 307 as the parachute 107 is released is prevented. The tube may have a relatively high friction outer surface so that the parachute 107 and tube tend to become released from the parachute compartment 339 together.

It may be preferable in some applications for the parachute 107 to be released before the net 105 is deployed, for example for timing purposes. Furthermore, in some applications, it may be preferable that the parachute 107 is fully inflated by the time the net 105 has captured the target object and the target object begins to descend. In order to facilitate inflation of the parachute, tension may be maintained on an attachment line connecting the parachute 107 and the projectile 101 after the parachute 107 has been released from the parachute compartment 339. However, if the attachment line is connected directly between the parachute 107 and the projectile 101, and if the parachute 107 inflates before the net has captured the target object, then the parachute 107 may impede or stop the projectile 101 as a result of excessive drag force.

To avoid this problem, a mechanism may be provided to deploy the attachment line in such a manner that tension is maintained on the attachment line while allowing the parachute 107 to inflate without impeding the projectile 101. It may be preferable that a controlled amount of tension is maintained on the attachment line, for example to control the rate at which the parachute 107 inflates to achieve an appropriate timing of inflation of the parachute 107.

For example, in some embodiments the attachment line may be attached to at least one of the parachute 107 and the projectile 101 by means of a reel on which the attachment line is wound. As the parachute 107 is released and inflates, the drag force of the parachute 107 causes the attachment line to unwind from the reel without impeding the projectile 101. Once the target object has been captured and the attachment line is fully unwound, the drag force of the parachute ensures a controlled descent of the captured object, net 105 and various parts of the projectile 101, which may be connected together by any suitable arrangement of tethers. In other embodiments the reel may be omitted and the attachment line may be simply coiled up inside the projectile 101.

Net Deployment Mechanism

A mechanism for deploying the net 105 from the net compartment 321 following separation of the body section 307 and the tail section 309 will now be described. For this purpose, the body section 307 comprises a number of net barrels 323, which are provided to fire the weight members 203 in divergent directions to thereby release the net 105 from the net compartment 321 and expand the net body 201.

Each barrel 323 comprises a closed end located in the interior of the body section 307 and an open end located at the external surface of the body section 307. Each net barrel 323 extends in a direction substantially perpendicular to the central axis C of the projectile 300.

The net barrels 323 are configured so as to allow a weight member 203 to be inserted into each net barrel 323. Each net barrel 323 is also provided with a stopper arrangement to control the position of the weight member 203 within the net barrel 323. For example, the interior surface of each net barrel 323 may comprise a portion having an internal diameter that is smaller than the external diameter of the weight members 203. Accordingly, when a weight member 203 is disposed in a net barrel 323, a closed volume of known size (referred to below as a "dead volume") is formed between the closed end of the net barrel 323 and the weight member 203.

The body section 307 comprises one or more components 325 for providing an expansion force within the dead volume of each net barrel 323. For example, the components 325 may comprise one or more squibs or gas generators. In the embodiment of FIGS. 6*a-i*, a squib 325 is disposed at the closed end of each net barrel 323. However, in other embodiments, a squib 325 may be shared between two or more net barrels 323. The squibs 325 are configured to be activated by activation signals generated by the control circuitry 303. When activated, a squib 325 causes a rapid build-up of pressure within the dead volume of a net barrel 323, thereby producing a force causing a corresponding weight member 203 to be expelled or fired from the net barrel 323 at relatively high speed. The net barrels 323 are oriented such that the weight members 203 are fired in divergent directions substantially perpendicular to the central axis C of the projectile 300.

Each net barrel 323 may have the same physical dimensions (e.g. length and/or cross-sectional area). Alternatively, some or all of the net barrels 323 may have different physical dimensions. Similarly, the dead volumes and/or squib characteristics may be the same or different for different net barrels 323. The physical dimensions of the net barrels 323, the dead volume sizes, and/or the squib characteristics may be selected to achieve a desired muzzle velocity of the weight members 203, for example as described further below.

A number of grooves 327 are provided on the exterior surface of the body section 307, wherein each groove 327 extends between the open end of a respective net barrel 323 and the join between the body section 307 and the tail section 309. In the embodiment of FIGS. 6*a-i*, the grooves 327 are substantially parallel to the central axis C of the projectile 300, although the skilled person will appreciate that the present invention is not limited to this arrangement. Each net cord 205 (connecting the net body 201 and the weight members 203) may be laid in a respective groove 327 when the net body 201 is packaged in the net compartment 321 and the weight members 203 are disposed in respective net barrels 323. Small holes may be provided in the projectile case 301 at the join between the body section 307 and the tail section 309 to enable the net cords 205 to pass between the grooves 327 and the net compartment 321.

The squibs 325 may be activated substantially simultaneously under the control of the control circuitry 303 once the net compartment 321 has been opened by separation of the body section 307 and the tail section 309. When the squibs 325 are activated, the weight members 203 are expelled from the net barrels 323, the net cords 205 are pulled out of the grooves 327 by the weight members 203, and the net body 201 is pulled out of the net compartment 321 by the net cords 205, thereby deploying the net 105. Expansion of the net 105 is facilitated by virtue of the divergent directions in which the weight members 203 are fired.

In certain exemplary embodiments, a tube similar to the one described above in relation to release of the parachute 107 may be provided in the net compartment 321 in a similar manner to facilitate deployment of the net 200.

Net Barrel Configurations

Figure 7:
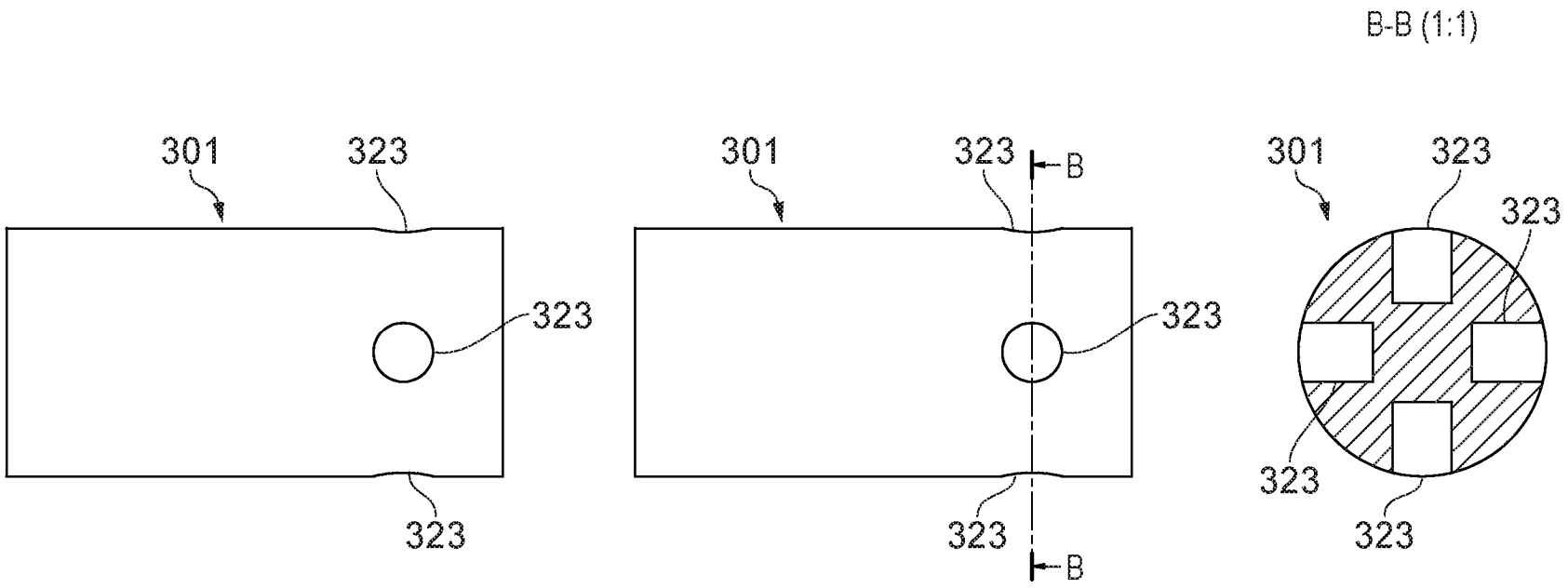
FIGS. 7-9 illustrate various configurations for the net barrels used in the projectile of FIGS. 6*a-i;*
Figure 8:
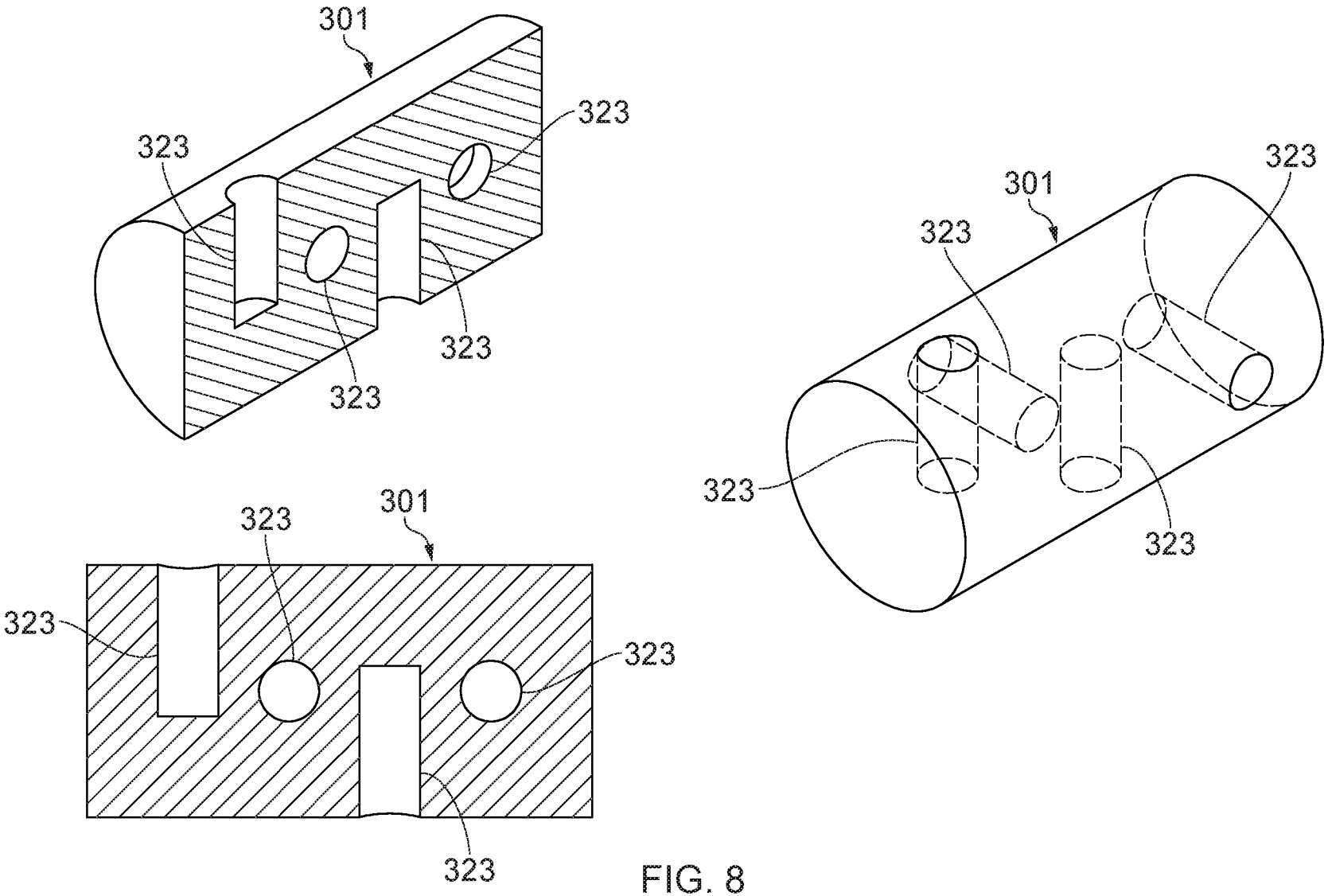
Figure 9:
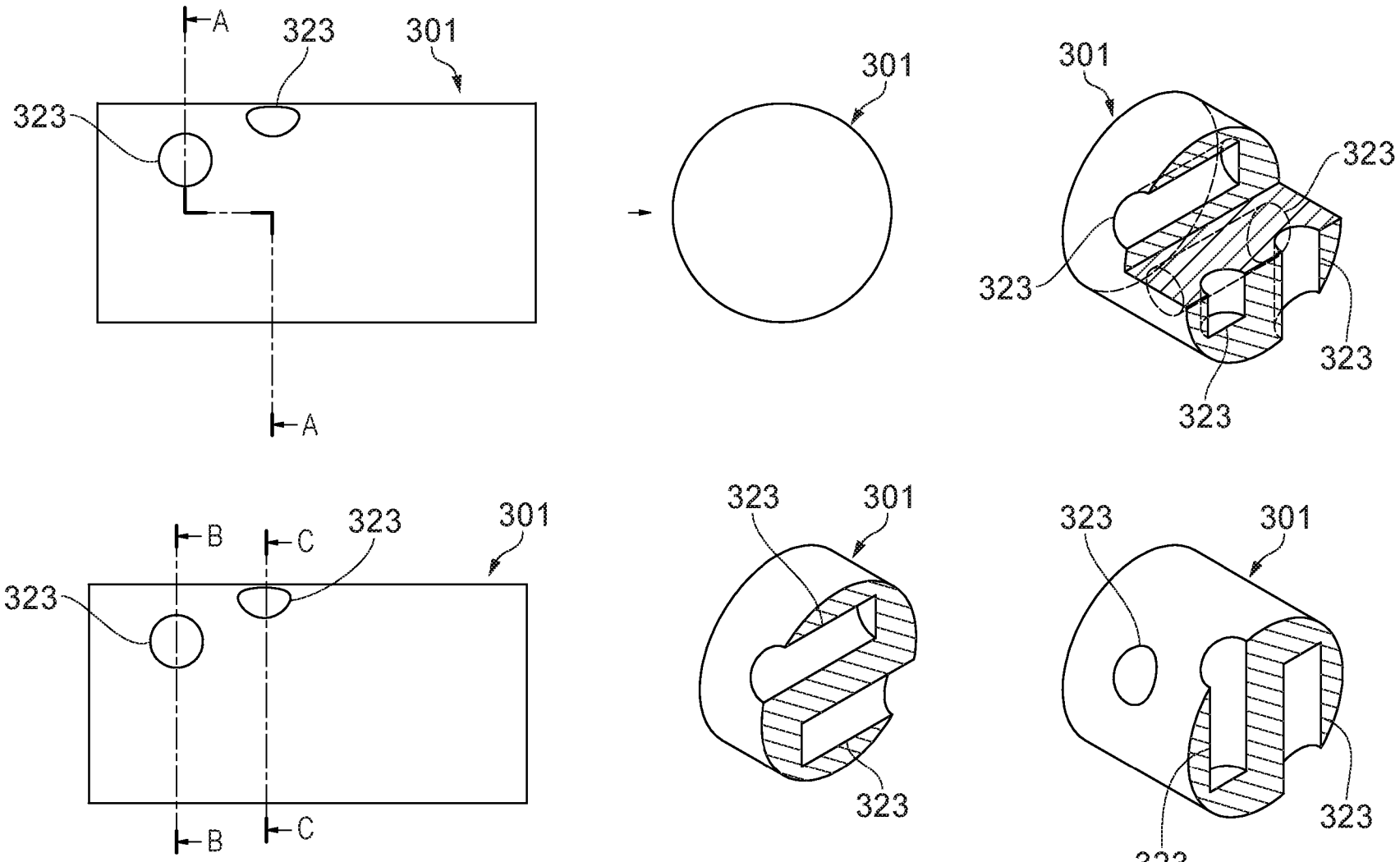

FIGS. 7-9 schematically illustrate various exemplary configurations of the net barrels, although the skilled person will appreciate that the present invention is not limited to these specific examples. For example, the configurations of FIGS. 7-9 include four net barrels, but the skilled person will appreciate that different numbers of net barrels may be provided depending on the number of weight members. Furthermore, in the exemplary configurations of FIGS. 7-9, the net barrels 323 are all arranged in directions substantially perpendicular to the central axis C of the projectile 101. However, in other embodiments, one or more of the net barrels 323 may be arranged in a direction that has a component in the direction of flight F of the projectile 101.

In a first exemplary configuration illustrated in FIG. 7, the net barrels 323*a-d* are arranged so as to extend radially from the central axis C of the projectile 101. The net barrels 323*a-d* are oriented at regular angles such that the open ends of the net barrels 323*a-d* are equally spaced around the circumference of the body section 307. The net barrels 323*a-d* are all located at the same axial position along the central axis C of the projectile 101. In this first configuration, the net barrels 323*a-d* each have a length approximately equal to the radius of the body section 307.

The speed at which a weight member 203 is fired from a net barrel 323 (i.e. the muzzle velocity) is dependent on the length of the net barrel 323, with a longer net barrel 323 providing a greater muzzle velocity. Accordingly, an exemplary design preference is to maximise the net barrel 323 length. In view of this design preference, the second and third configurations described below comprise longer net barrels 323 than the first configuration.

In a second exemplary configuration illustrated in FIG. 8, the net barrels 323*a-d* are arranged so as to extend across most, or substantially all, of the diameter of the body section 307 through the central axis C of the projectile 101. The first and second net barrels 323*a*, 323*b* are arranged in parallel, but pointing in opposite directions, such that the open ends of the first and second net barrels 323*a*, 323*b* are located at opposite sides of the body section 307. Similarly, the third and fourth net barrels 323*c*, 323*d* are arranged in parallel but pointing in opposite directions, such that the open ends of the third and fourth net barrels 323*c*, 323*d* are located at opposite sides of the body section 307. The first and second net barrels 323*a*, 323*b* are arranged at an angle of 90 degrees to the third and fourth net barrels 323*c*, 323*d*. In order to accommodate the net barrels 323*a-d*, the net barrels 323*a-d* are all arranged at different axial positions along the central axis C of the projectile 101. That is, the net barrels 323*a-d* are stacked along the length of the body section 307.

In the second configuration described above, the net barrels 323*a-d* are stacked along the length of the body section 307. Therefore, a relatively long length of the body section 307 is used to accommodate the net barrels 323*a-d* in comparison to the first configuration. Another exemplary design preference is to minimise the length of the body section 307 required to accommodate the net barrels 323*a-d* to minimise the overall length of the projectile 101. In view of this design preference, the third configuration described below provides an arrangement in which the net barrels 323*a-d* may be accommodated in a shorter length of the body section 307.

In a third exemplary configuration illustrated in FIG. 9, the first and second net barrels 323*a*, 323*b* are arranged in parallel, but pointing in opposite directions, and are also arranged either side of the central axis C of the projectile 101 so as to be adjacent to each other. Similarly, the third and fourth net barrels 323*c*, 323*d* are arranged in parallel, but pointing in opposite directions, and are also arranged either side of the central axis C of the projectile 101 so as to be adjacent. The first and second net barrels 323*a*, 323*b* are arranged at an angle of 90 degrees to the third and fourth net barrels 323*c*, 323*d*. The first and second net barrels 323*a*, 323*b* are arranged at the same axial position along the central axis C of the projectile 101. The third and fourth net barrels 323*c*, 323*d* are also arranged at the same axial position along the central axis C of the projectile 101, but at a different axial position to the first and second net barrels 323*a*, 323*b*. That is, in this third configuration, the net barrels 323*a-d* are stacked along the length of the body section 307 in pairs. Accordingly, only half the length of the body section 307 is required to accommodate the net barrels 323*a-d* in comparison to the second configuration, at the cost of only a small reduction in the net barrel 232 length.

In the third configuration, since the first and second net barrels 323*a*, 323*b* are offset from each other, the weight members 203 fired from these net barrels 323*a*, 323*b* will impart a moment on the net body 201 and/or the projectile 101, tending to cause the net body 201 and/or projectile 101 to rotate, reducing stability. Similarly, the weight members 203 fired from the third and fourth net barrels 323*c*, 323*d* will also tend to cause the net body 201 and/or projectile 101 to rotate. To avoid this problem, the net barrels 323*a-d* may be arranged (as illustrated in FIG. 9) such that the moment imparted by the weight members 203 fired from the first and second net barrels 323*a*, 323*b* is in an opposite direction to (and hence will tend to cancel out) the moment imparted by the weight members 203 fired from the third and fourth net barrels 323*c*, 323*d*. Accordingly, with this arrangement, undesired rotation or other destabilising motion of the net body 201 and/or projectile 101 may be reduced or eliminated.

In general, one or more factors, for example the number of net barrels 323, the positions of the net barrels 323, the orientations of the net barrels 323, and the muzzle velocities of the weight members 203 (determined according to various factors, for example as described above), may be selected so as to increase or maximise the stability of the net 200 and/or projectile 101 following net deployment. For example, these factors may be selected such that the forces (e.g. moments and/or linear forces) applied to the net 200 by the weight members 203 tend to balance.

Dead Volume Control

In certain embodiments described above, expansion forces provided by squibs 325, 337 are used to separate the body section 307 and the tail section 309, and to fire the weight members 203 from the net barrels 323*a-d*. It is desirable to control the speed at which the body section 307 and tail section 309 separate in order to control the timing of net deployment, which is dependent on the projectile separation speed. In addition, it is desirable to control the speed at which the weight members 203 are fired from the net barrels 323*a-d*. For example, if the muzzle velocity of the weight members 323*a-d* is too high then the net 200 may be damaged.

Factors affecting the projectile separation speed and the muzzle velocity of the weight members 203 include the energy input by a squib 325, 337 and the size of the volume in which the squib 325, 337 detonates (i.e. the "dead volume"). Since squibs are typically available in certain predefined sizes, it may be more convenient to control the projectile separation speed and the muzzle velocity of the weight members 203 by controlling the dead volumes. The selection of a dead volume size to achieve a certain desired projectile separation speed or weight member 203 muzzle velocity may be made based on the following principles.

Squibs may be characterised by how much pressure they can build up in a certain volume (for example, 65 bar in a 3 cubic centimetre (cc) volume) and/or by the time taken to generate this pressure. When a projectile is fired from a barrel as a result of detonation of a squib, the muzzle velocity may be given by:

$$V_m^2 = \frac{2}{m}\int_{V_0}^{V_0+AL}\left[p_0\left(\frac{V_0}{V}\right)^{\gamma} - \frac{f}{A}\right]dV$$

In the above equation, $V_m$ is the muzzle velocity, m is the projectile mass, $V_0$ is the dead volume, A is the cross-sectional area of the barrel, L is the barrel length, $\gamma$ is the gas constant of the working gas (for example, $\gamma$=1.4 for air), and $f$ is the friction between the barrel and the projectile. In addition, $p_0$ is a function of $V_0$ and the squib characteristics mentioned above. For example, if $V_0$=6 cc and the squib has a characteristic of building up 65 bar in 3 cc, then $p_0$=32.5 bar.

The above equation assumes that the expansion of the gas as the projectile accelerates along the barrel is adiabatic, and also that the squib instantaneously produces the characteristic pressure. The latter assumption may be regarded as valid if the following inequality is satisfied:

$$\frac{p_0 A t^2}{\mathrm{mL}} < 0.001$$

In the above inequality, t is the time taken for the squib to produce the characteristic pressure. If the above inequality is not satisfied, a more complex calculation may be required that takes into account how the projectile starts to accelerate during the gas generation phase. However, this requirement may be mitigated by restraining the projectile (e.g. using a canted spring, shear pin or other mechanical fuse) until the pressure behind the projectile has reached a level slightly lower than $p_0$.

The above equation may be solved analytically or using numerical methods, for example depending on whether or not the friction $f$ is constant or has a relatively complex relationship with pressure (and hence volume).

Projectile Launch and Deployment Sequence

Figure 14:
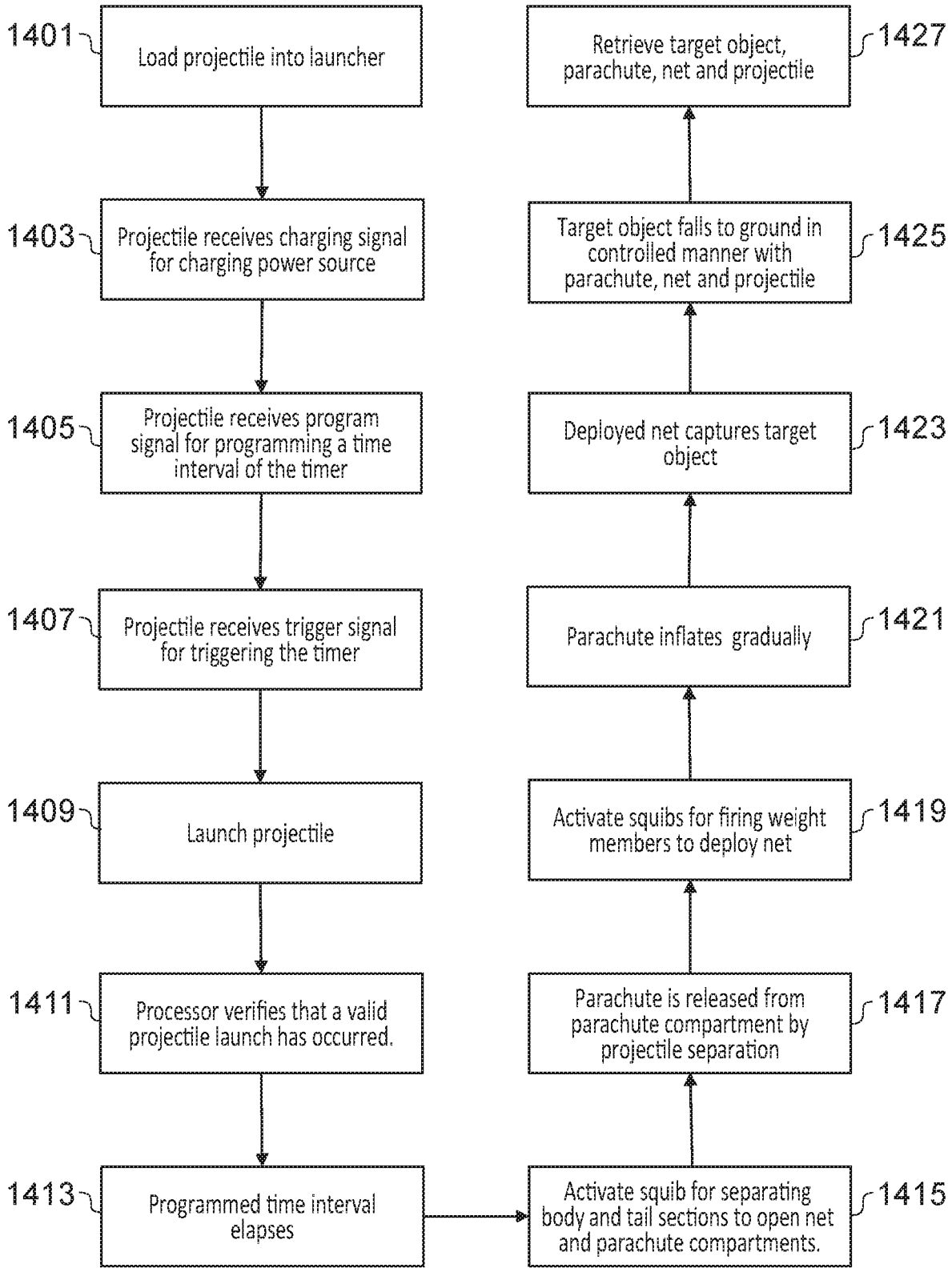
FIG. 14 is a flow diagram of an exemplary projectile launch and deployment sequence.

An exemplary sequence for launching the projectile 101, releasing the parachute 107 and deploying the net 200 will now be described with reference to FIG. 14. The skilled person will appreciate that certain steps of FIG. 14 may be performed in a different order in alternative embodiments.

First, the projectile 101 is loaded into the launcher 103 (Step 1401). When the projectile 300 is correctly loaded in the launcher 103, the contacts 319 of the projectile 300 connect with corresponding contacts in the launcher 103 allowing the launcher 103 to transmit signals to the projectile 300. In particular, the power source 313 receives a charging signal for charging the power source 313 (Step 1403). Furthermore, the processor 317 receives a program signal from the launcher 103 via a relevant contact 319 and programs a time interval of the timer 315 based on the program signal (Step 1405). In certain embodiments, the processor 317 may continuously (e.g. periodically) receive updated program signals from the launcher 103 while the projectile 101 is correctly loaded in the launcher 103, and the processor 317 may continuously (e.g. periodically) reprogram the time interval of the timer 315 accordingly. The processor 317 also receives a trigger signal from the launcher 103 via a relevant contact 319 and controls triggering of the timer 315 based on the trigger signal (Step 1407). Here, it is assumed that the launcher 103 is correctly aimed, and that the launcher 103 has performed all necessary initialisation procedures, calculations and safety checks, as described further below.

The launcher 103 launches the projectile 300 immediately after providing the trigger signal (Step 1409), and the processor 317 verifies that valid launch of the projectile 101 has occurred, for example in the manner described below (Step 1411). The timer 315 outputs a timer signal to the processor 317 when the programmed time interval has elapsed (Step 1413), and in response, if the processor 317 has verified valid projectile launch, the processor 317 activates the squib 337 for separating the body section 307 and the tail section 309 (Step 1415), for example a time $t_1$ after launch of the projectile. As a result of projectile separation, the parachute 107 is pulled out of, and thereby released from, the parachute compartment 339 (Step 1417).

The processor 317 then activates the squibs 325 for firing the weight members 203 a certain time $\Delta t$ after activating squib 337 (Step 1419), i.e. a time $t_2=t_1+\Delta t$ after launch of the projectile. The delay, $\Delta t$, between activating squib 327 and squibs 325 may be preset and chosen to allow the body section 307 and tail section 309 to separate a sufficient distance to allow unrestricted net deployment before the net 200 is actually deployed, and to allow the parachute 107 to be released before the net 200 is deployed.

As a result of activation of squib 337, the tail section 309 and body section 307 are urged apart, and the flight speed of the tail section 309 slows relative to that of the body section 307. A space opens up between the separated tail section 309 and body section 307, thereby opening the net compartment 321 and parachute compartment 339. The separation of the projectile 300 causes the parachute 107 to be pulled out of the parachute compartment 339 into the airstream by a tether in the manner described above. As the parachute 107 inflates (Step 1421), an attachment line connecting the parachute 107 to the projectile 300 unwinds from a reel in the manner described above, allowing the parachute to inflate without impeding the projectile 300.

Meanwhile, as a result of activation of squibs 325, the weight members 203 are fired from the net barrels 323 in divergent directions, causing the net cords 205 to be pulled out of the grooves 327 by the weight members 203 and the net body 201 to be pulled out of the net compartment 321 by the net cords 205. Since the flight speed of the body section 307 is higher than that of the tail section 309 following projectile separation, the net body 201 is pulled forwards relative to the separated tail section 309, thereby facilitating deployment of the net body 201 from the net compartment 321.

In the embodiments described above, the weight members 203 are fired from the net barrels 323 in directions substantially perpendicular to the central axis C of the projectile 300. However, since the projectile is moving forwards when the net 200 is deployed, the net 200 also moves forwards following deployment. That is, the forward momentum of the projectile 101 is used to deploy the net 200 in a forwards direction. Accordingly, the proportion of the momentum of the weight members 203 used to expand the net 200 is maximised since the momentum of the weight members 203 is not required to provide forwards momentum to the net 200.

As a result of correct timing of net deployment, the net 200 is deployed in the vicinity of the target object and in a direction towards the target object. Accordingly, the deployed net 200 entangles and captures the target object (Step 1423). The net 200, parachute 107 and separated parts of the projectile 101 are connected by tethers to avoid dispersion. The parachute 107, which is fully inflated by the time the target object is captured, ensures that the target object, net 200, parachute 107 and separated parts of the projectile 101 fall to the ground in a controlled manner (Step 1425). Once grounded, the target object, net 200, parachute 107 and parts of the projectile 101 may be safely retrieved since the projectile 101 is rendered inert by the discharged state of the power source 313 (Step 1427).

In certain embodiments, the projectile 300 is configured so as to be reusable. For example, when the various parts have been retrieved following use, a new squib 337 may be provided in the dead volume of the projectile 300, new squibs 325 may be provided in each of the net barrels 323, the net 105 may be re-packaged into the net compartment 321, the parachute 107 may be re-packaged into the parachute compartment 339, the net cords 205 may be re-laid in the grooves 327 of the body section 307, the weight members 203 may be disposed in the net barrels 323, securing member 333 may be re-fitted (or re-engaged), and the body section 307 and the tail section 309 of the projectile 300 may be re-joined.

Net Deployment Safety Mechanisms

In certain embodiments, the control circuitry 303 may apply one or more safety mechanisms to reduce the risk of accidental or mistimed deployment of the net 105, for example when the projectile 300 is not in use or is in the launcher 103.

For example, according to a first exemplary safety criterion, the control circuitry 303 is required to receive a valid launch verification signal through an appropriate contact 319 before net deployment can be initiated. The launch verification signal is generated by the launcher 103 and output to the projectile 300 when the projectile 300 is correctly loaded in the launcher 103. A valid launch verification signal indicates that the launcher 103 has verified that the projectile 300 has been correctly loaded in the launcher 103, and that the launcher 103 has completed a launch initiation procedure. In certain embodiments, the trigger signal may be used as the launch verification signal.

According to a second exemplary safety criterion, the control circuitry 103 is required to detect an electrical connection followed by an electrical disconnection between the projectile 300 and the launcher 103 before net deployment can be initiated. For example, when the projectile 300 is correctly loaded in the launcher 103, connections between one or more of the projectile contacts 319 and one or more corresponding launcher contacts closes a detection circuit provided in the control circuitry 303. When the projectile 300 is launched, the connections between the contacts are broken and the detection circuit is opened. Accordingly, the detection circuit may detect electrical connection and disconnection between the projectile 300 and the launcher 103 by detected opening and closing of the detection circuit. An electrical connection followed by an electrical disconnection between the projectile 300 and the launcher 103 indicates that the projectile 300 has been correctly loaded in the launcher 103 and subsequently launched.

According to a third exemplary safety criterion, the control circuitry 103 is required to verify that an acceleration force experienced by the projectile 300 is greater than a certain threshold before net deployment can be initiated. The acceleration force may be measured by an accelerometer provided in the control circuitry 303. The threshold may be set to a level slightly below the typical acceleration force experienced by a projectile 300 during a successful launch. Accordingly, an acceleration force greater than the threshold indicates successful launch of the projectile 300 from the launcher 103.

In certain embodiments, the control circuitry 303 may be configured such that all of the first to third safety criteria described above must be satisfied before net deployment can be initiated. Alternatively, the control circuitry 303 may be configured to apply only some of these criteria. The skilled person will appreciate that safety criteria other than those described above may also be applied. The safety mechanisms may be implemented in hardware to increase overall safety.

In certain embodiments, one or more (or all) of the safety criteria must be satisfied within a certain time window before net deployment can be initiated. For example, the time window may be set based on the typical time required for the projectile to exit the launcher 103 after launch of the projectile 101 is initiated (e.g. 40 ms).

Launcher

Figure 10A:
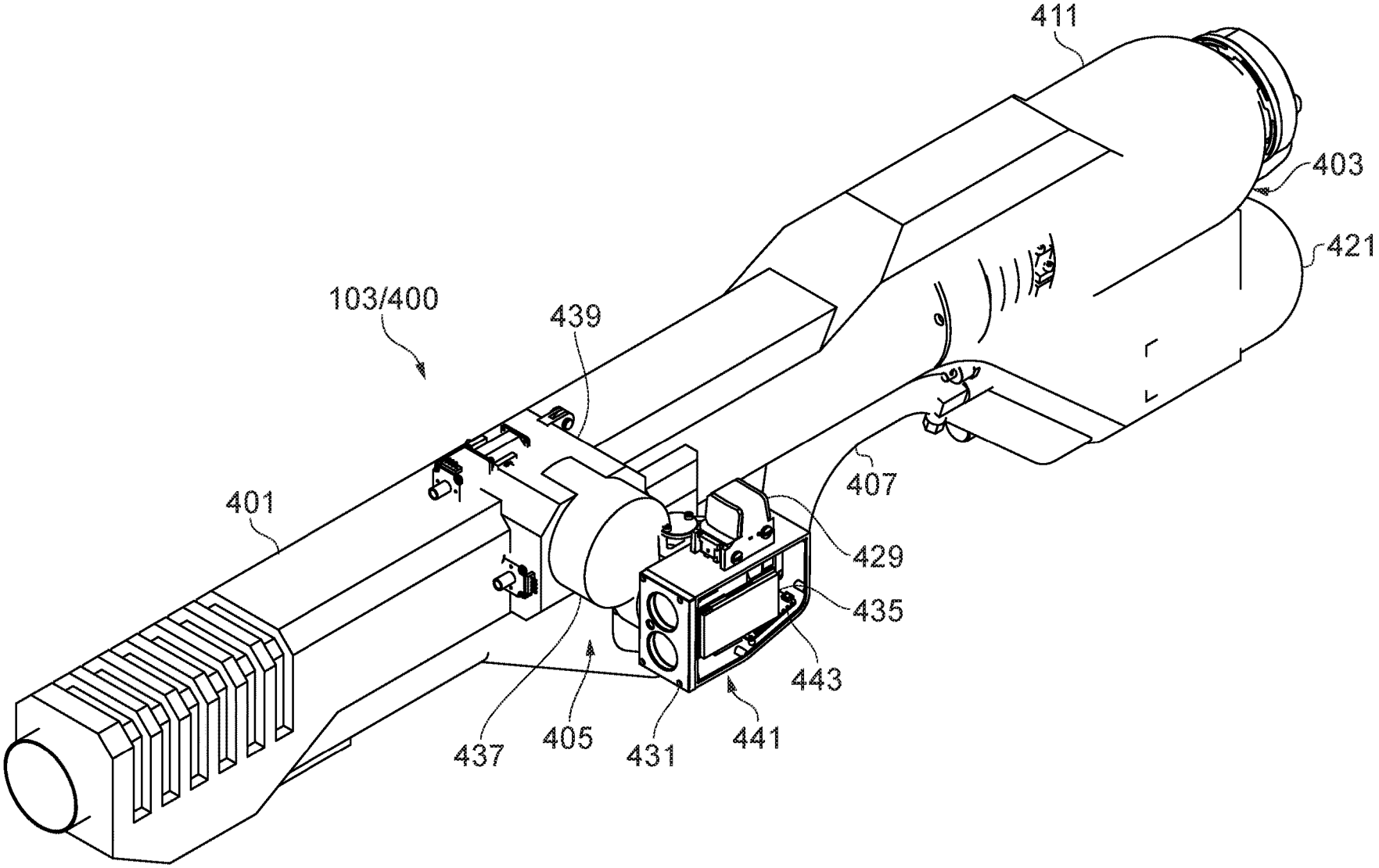
FIGS. 10*a-c* illustrate an exemplary launcher for use in the system of FIGS. 1*a-c;*
Figure 10B:
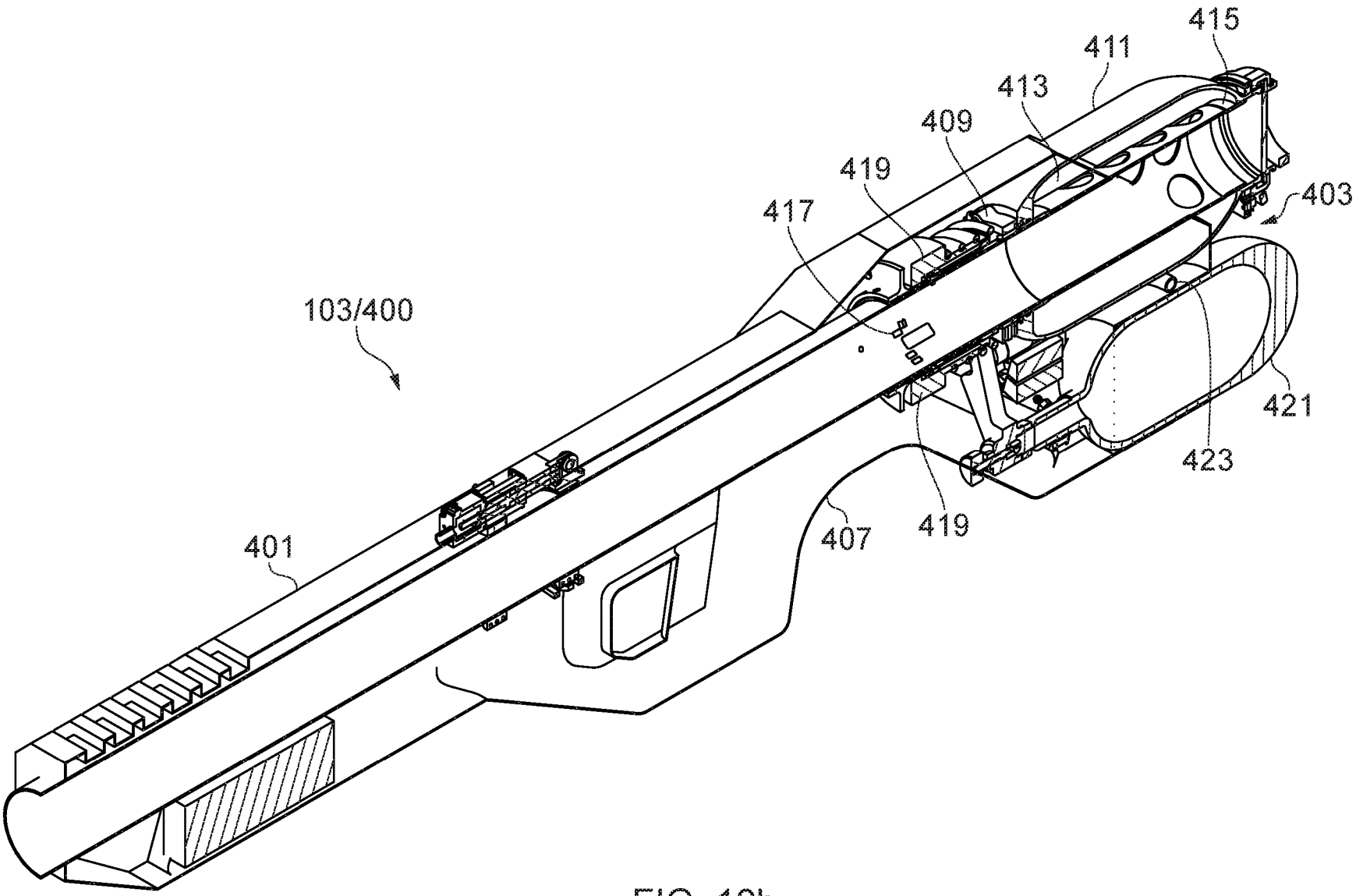
Figure 10C:
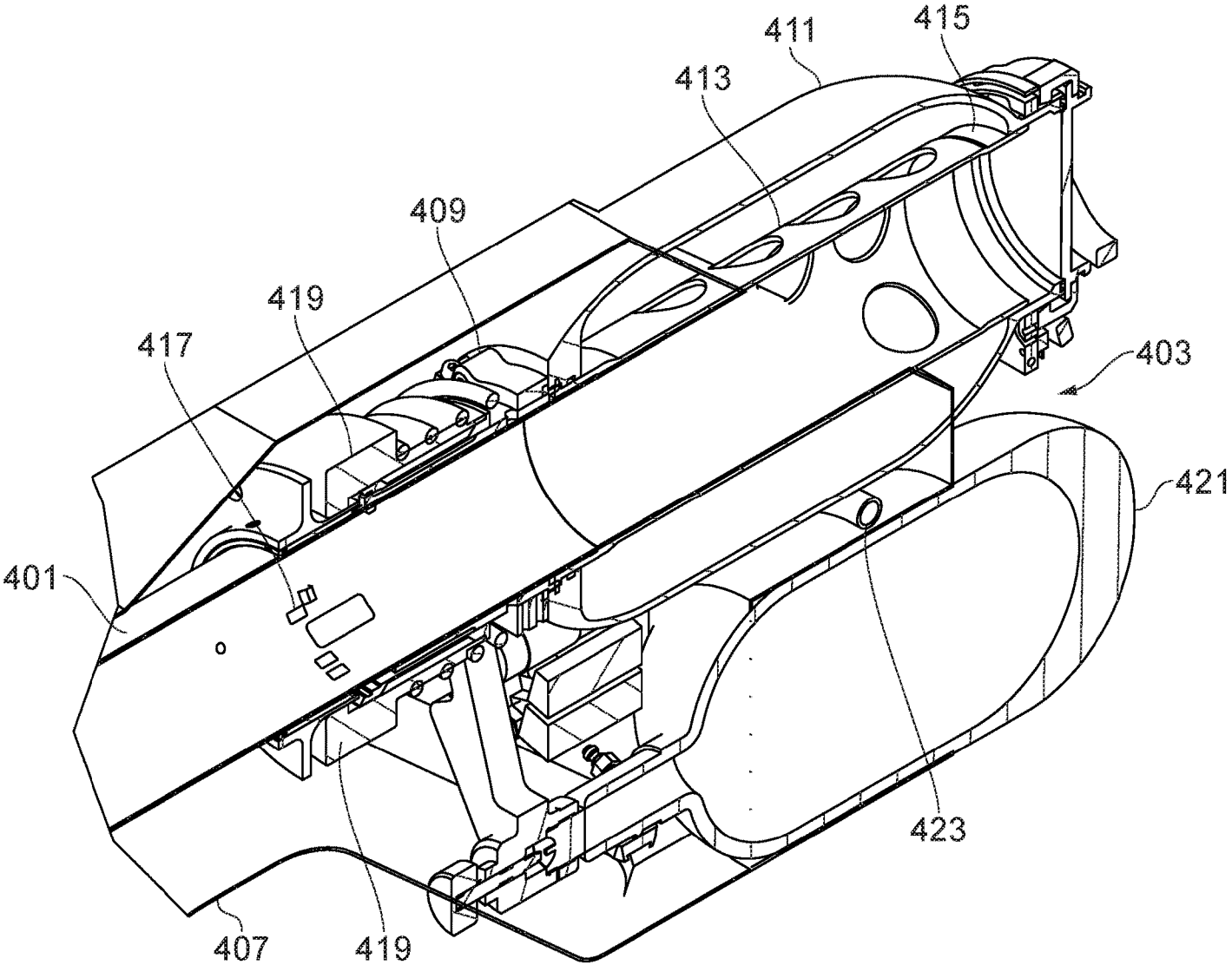

The launcher 103 will now be described in more detail. The launcher 103 may comprise any suitable launcher for launching the projectile 300. One example of a launcher 103 for use in the system 100 of FIGS. 1*a-c* is illustrated in FIGS. 10*a-c*. FIG. 10*a* is an external axonometric view of the launcher 103. FIG. 10*b* is a cross-sectional axonometric view of the launcher 103. FIG. 10*c* is a cross-sectional axonometric view of a rear portion of the launcher magnified relative to FIG. 10*b*.

Figure 11A:
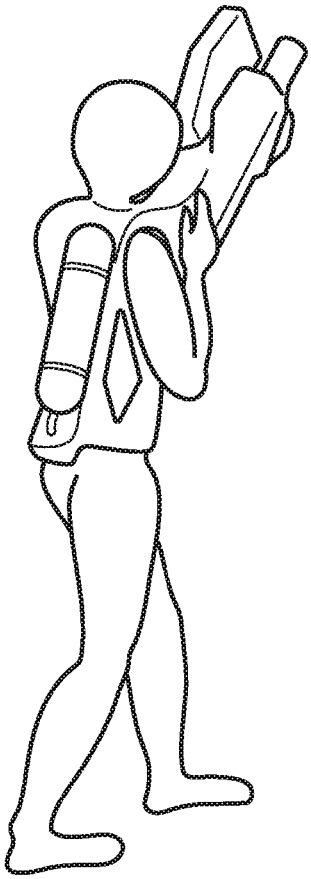
FIGS. 11*a-c* illustrate alternative launcher designs for use in the system of FIGS. 1*a-c;*
Figure 11B:
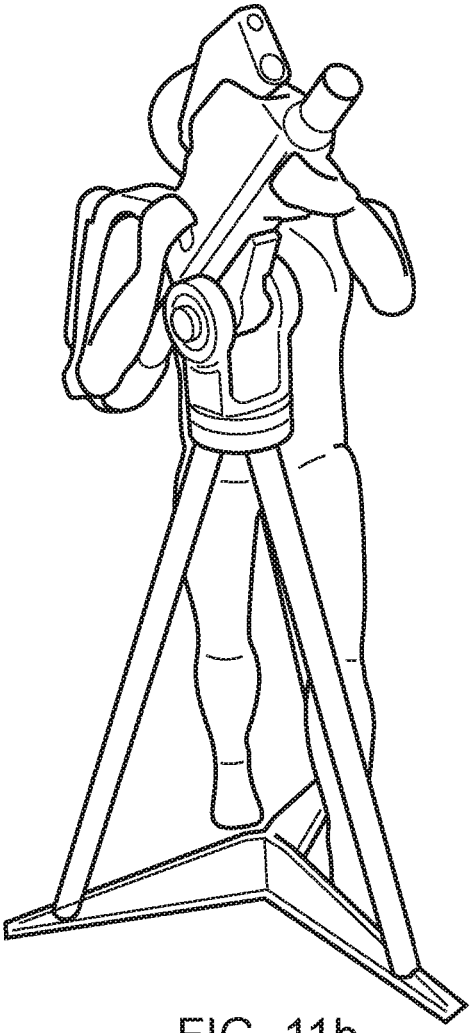
Figure 11C:
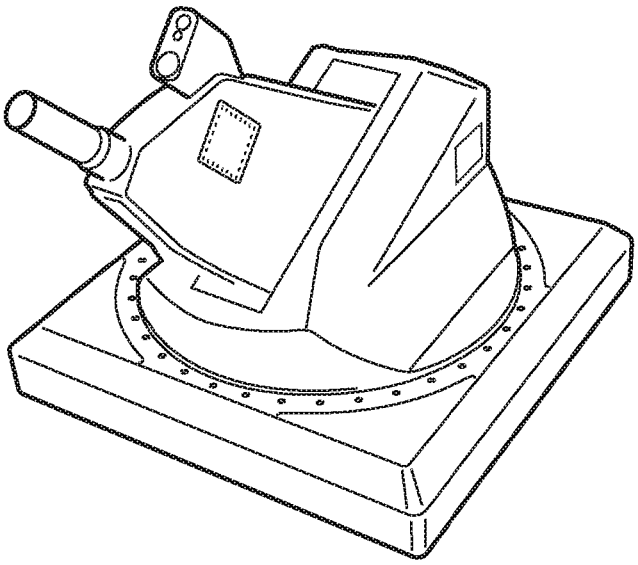

The skilled person will appreciate that the present invention is not limited to the exemplary embodiment of FIGS. 10*a-c*. For example, the launcher may be adapted to be manually operated by a user and supported on the user's shoulder (as illustrated in FIG. 11*a*). In other embodiments, the launcher may be adapted to be supported at least partially by a stand (as illustrated in FIG. 11*b*) or placed directly on the ground (as illustrated in FIG. 11*c*). Furthermore, in certain embodiments, the launcher may be adapted to be at least partially automated (e.g. by using a camera and image processing, or sensors, to automatically identify and track a target object).

The skilled person will also appreciate that the launcher 103 disclosed herein may be used to launch any suitable type of projectile, for example a projectile used for deploying a net or other object for reasons other than for capturing, immobilising or disabling a second object, or a projectile that is not used for deploying a net or other object.

The launcher 400 of FIGS. 10*a-c* comprises a forward facing barrel 401 into which the projectile 300 may be inserted, a firing mechanism 403 located towards the rear of the launcher 400 for firing or launching the projectile 300 from the barrel 401, an aiming system 405 for assisting the user or operator in correctly aiming the barrel 401, a support 407 for assisting the user to support the weight of the launcher 400, and control circuitry 409 for controlling overall operation of the launcher 400.

In the embodiment of FIGS. 10*a-c*, the support 407 comprises a shoulder rest provided on the underside of the launcher 400 to help the user to support the weight of the launcher 400 on one shoulder during use.

The projectile 300 may be loaded into the launcher 400 in any suitable way. For example, in some embodiments the projectile 300 may be inserted into the forward open end of the barrel 401 and slid backwards inside the barrel 401 to the correct launch position. In other embodiments, the projectile 300 may be inserted into the barrel 401 through a closable door or hatch provided in the side of the barrel 401 at an appropriate position along its length. In other embodiments, the projectile 300 may be loaded via the rear of the launcher 400. For example, the rear of the launcher 400 may be configured to be unscrewed or otherwise detached to enable the projectile 300 to be loaded, and then to be screwed back on or otherwise reattached.

The firing mechanism 403 comprises a pressure chamber 403, a gas reservoir 421 (e.g. a high pressure gas reservoir), a gas supply pipe 423, a number of latches or retaining fingers 409, and a trigger 425. In the embodiment of FIGS. 10*a-c*, the firing mechanism 403 is configured for pneumatically launching the projectile 300 in a manner described further below. However, the skilled person will appreciate that any other suitable technique for launching the projectile 300 may be used in other embodiments.

The barrel 401 comprises a double open ended tube having an internal cross section substantially the same size and shape as the external cross section of the body section 307 of the projectile 300. The rear open end of the barrel 401 is connected to an opening in a front wall of the pressure chamber 411 such that the interior of the barrel 401 and the interior of the pressure chamber 411 form a continuous volume. In the embodiment of FIGS. 10*a-c*, an extension portion 413 forming an extension of the rear end of the barrel 401 protrudes into the pressure chamber 411. However, in alternative embodiments, the extension portion 413 may be omitted. The extension portion 413 may be perforated.

A stopper member 415 may be provided to prevent the projectile 300, when inserted into the barrel 401, from sliding backwards beyond a certain position along the barrel 401. In particular, the stopper member 415 is arranged to stop the projectile 300 at the correct position for launch (referred to below as the "launch position"). For example, the stopper may comprise an O-shaped cap disposed at the rear end of the extension portion 413.

One or more electrical contacts 417 are disposed on the interior of the barrel 401 and arranged such that when the projectile 300 is correctly located at the launch position, the contacts 417 connect with corresponding contacts 319 disposed on the exterior of the projectile 300. The contacts 417 are electrically connected to outputs of the control circuitry 409 and provide an output interface for the control circuitry 409. In particular, the contacts 417 enable the launcher 400 to output various signal to the projectile 300, including a charging signal for charging the power source 313 of the projectile 300, a program signal for programming the timer 315 of the projectile 300, and a trigger signal for triggering the timer 315 of the projectile 300.

As mentioned above, in certain embodiments, one or more of the signals (e.g. the program signal and/or the trigger signal) may be transmitted from the launcher 103 to the projectile 101 without using electrical contacts, for example wirelessly (e.g. using Near Field Communication, NFC). In this case, one or more of the contacts 417 may be omitted and the launcher 103 may be provided with a wireless communication module. Furthermore, in this case, the signals may be transmitted to the projectile 101 either before or after launch of the projectile 101.

The control circuitry 409 comprises a detection circuit for detecting when the projectile is correctly located at the launch position. For example, when the projectile 300 is at the launch position, connections between one or more of the launcher contacts 417 and one or more corresponding projectile contacts 319 closes the detection circuit. On the other hand, when the projectile 300 is not at the launch position, the detection circuit is in an open state. Accordingly, the detection circuit may determine whether the projectile 300 is at the launch position based on whether the detection circuit is in an open state or closed state. The skilled person will appreciate that the launcher 400 may detect when the projectile is correctly located at the launch position in any other suitable manner, for example by detecting actuation of a switch or the like by the projectile 300 when located at the launch position.

The internal cross section of the barrel 401 is sized so that when the projectile 300 is located at the launch position, the body of the projectile 300 and the seal member 341 surrounding the body of the projectile 300 together form an airtight seal between the interior volume of the pressure chamber 411 and the interior volume of the forward end of the barrel 401. The airtight seal allows pressure to build up behind the projectile 300 when the pressure chamber 411 is pressurised.

The latches 419 are disposed circumferentially around the exterior of the barrel 401 at a position along the barrel 401 forward of the airtight seal formed by the body of the projectile 300 and the seal member 341. The latches 419 are configured to pass through holes in the barrel 401 and engage with corresponding slots 343 provided on the exterior surface of the projectile 300 when the projectile 300 is located at the launch position. The latches 419, when engaged with the slots 343, prevent forward movement of the projectile 300 within the barrel 401, for example when the pressure chamber 411 is pressurised. Conversely, the latches 419, when disengaged, allow forward movement of the projectile 300, in particular for launch of the projectile 300. The control circuitry 409 is configured to control engagement and disengagement of the latches 419.

Any suitable number of latches 419 may be provided, and the latches 419 may be disposed in any suitable positions. In certain embodiments, the latches 419 are disposed evenly around the circumference of the barrel 419. If only one or two latches 419 are provided, the projectile 300 may tend to pivot slightly about the latch points, potentially causing instability when the projectile 300 is launched. Therefore, in certain embodiments, at least three latches 419 may be provided to prevent pivoting, thereby increasing stability and uniformity of release of the projectile 300 when launched.

Figure 12:
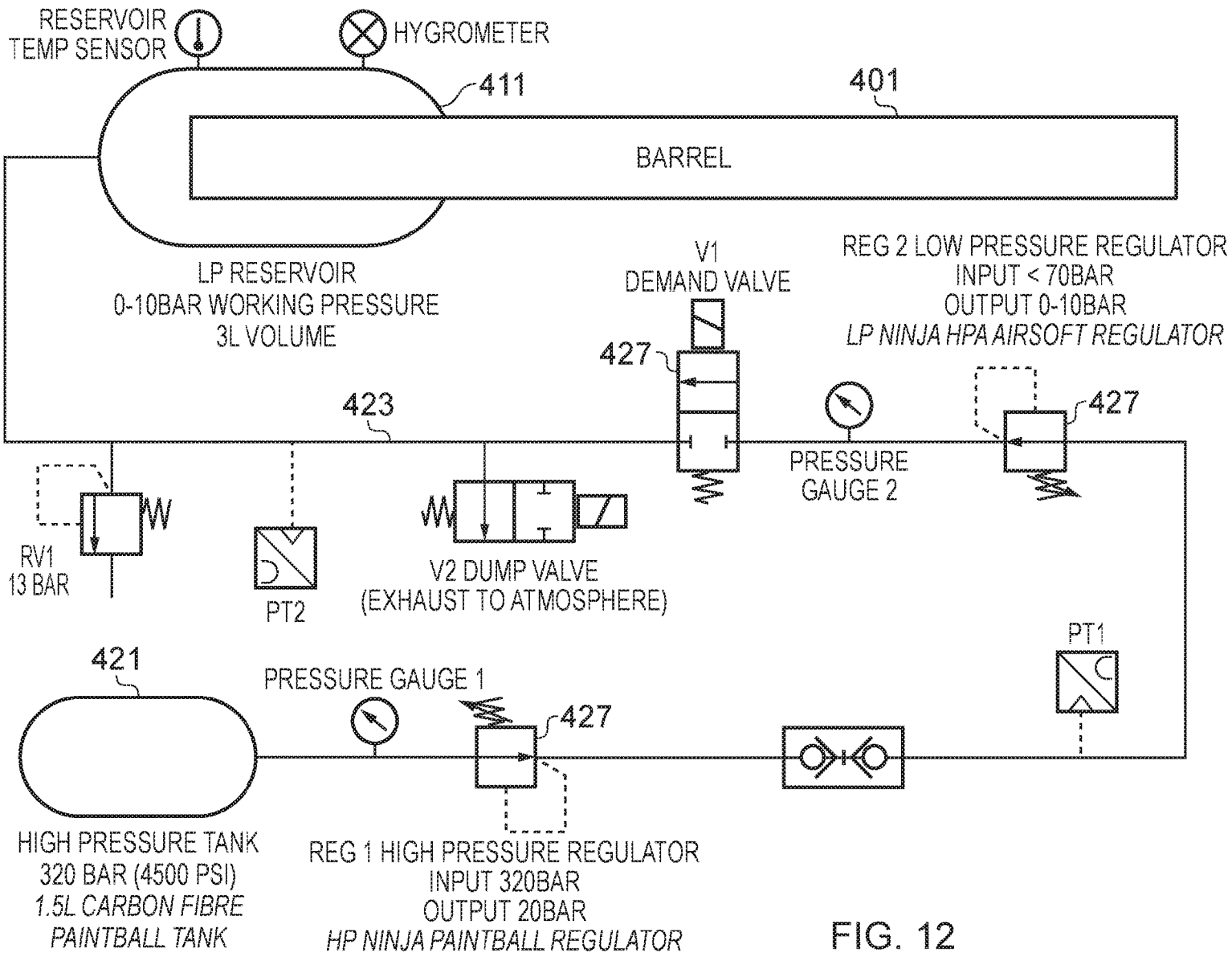
FIG. 12 illustrates an exemplary arrangement for pressurising a pressure chamber with gas supplied from a high pressure reservoir via a number of gas regulation valves.

The (relatively) high pressure gas reservoir 421 (for example having a pressure of approximately 320 bar) is configured for supplying gas for pressurising the pressure chamber 411 to a desired pressure (for example approximately 10 bar). An outlet of the high pressure gas reservoir 421 is connected to an inlet of the pressure chamber 411 by the gas supply pipe 423. Supply of gas from the high pressure gas reservoir 421 to the pressure chamber 411 is regulated by one or more gas regulation values 427 disposed along the gas supply pipe 423. The control circuitry 409 is configured for controlling the gas regulation valves 427. FIG. 12 schematically illustrates an exemplary arrangement for pressurising a pressure chamber 411 with gas supplied from a high pressure reservoir 421 via a number of gas regulation valves 427.

When the gas regulation valves 427 are opened, gas from the high pressure reservoir 421 enters the pressure chamber 411 via the gas supply pipe 423. If the projectile 300 is located at the launch position, the airtight seal formed by the body of the projectile 300 and the seal member 341 prevents escape of gas through the barrel 401, allowing pressure to build up behind the projectile 300. In certain embodiments, as a safety mechanism, the control circuitry 409 may be configured to open the gas regulation values 427 only once the projectile 300 is detected at the launch position. If the projectile 300 is loaded from the rear in the manner described above, the control circuitry 409 may be configured to open the gas regulation values 427 only once the rear of the launcher has been screwed back on or otherwise reattached.

When the pressure chamber 411 becomes pressurised, a forward force is exerted on the projectile 300 from the pressurised gas. However, if the latches 419 are engaged, the projectile 300 is prevented from moving forwards and the airtight seal is maintained. On the other hand, when the pressure in the pressure chamber 411 has reached the required level, and the latches 419 are simultaneously disengaged, the force exerted on the projectile 300 causes the projectile 300 to be expelled or fired from the front end of the barrel 401 at a relatively high speed.

The trigger 425 allows the user to trigger launch of the projectile 300. For example, the trigger 325 may comprise a conventional gun trigger, or alternatively a button, switch or the like. In the case of a conventional gun trigger or the like, a trigger sensor (e.g. microswitch) may be provided to detect physical actuation of the trigger 325 beyond a certain threshold position. For example, actuation of the trigger 325 beyond the threshold position may cause the microswitch to be switched from an open state to a closed state (or vice versa). The control circuitry 409 is configured for disengaging the latches 419 in response to actuation of the trigger 425 by the user. Before controlling disengagement of the latches 419, the control circuitry 409 outputs various signals to the contacts 417, including the program signal for programming the timer 315 of the projectile 300, and the trigger signal for triggering the timer 315 of the projectile 300.

In certain embodiments, as an exemplary safety mechanism, actuation of the trigger 425 may be physically prevented until a launch initialisation procedure has been completed and/or one or more safety criteria are satisfied (as described further below). For example, actuation of the trigger 425 may be physically prevented by a releasable trigger lock, for example in the form of a releasable bolt, which physically blocks movement of the trigger 425 until the trigger lock is released. The trigger lock may be released in response to a signal generated when the initialisation procedure has been completed and/or the safety criteria are satisfied.

In certain embodiments, as another exemplary safety mechanism, the launcher may be provided with one or more guard buttons, which the user is required to hold down before the trigger lock may be released.

In certain embodiments, as another exemplary safety mechanism, the trigger sensor may be required to detect valid triggering of the trigger 325 before launch of the projectile 101 is performed. For example, a launch circuit (e.g. separate from the control circuitry 409) for providing a final launch signal may be electrically closed by switching of the microswitch forming the trigger sensor.

Aiming System

One example of an aiming system 405 for use in the launcher 400 of FIGS. 10*a-c* will now be described in detail. The skilled person will appreciate that the present invention is not limited to this specific example.

During use, it is difficult for the user to manually determine the correct direction in which to aim the barrel 401, and to manually determine the correct timing required for deployment of the net 200. For example, simply pointing the barrel 401 in the direct line of sight towards a target object typically would not result in successful capture of the target object due to various factors, for example the effects of gravity, movement of the target object, and wind speed. In addition, although the net 200 should intercept the target object, it is preferable that the projectile 300 itself does not intercept the target object, for example to avoid damaging the projectile 300 and/or the target object. Accordingly, the aiming system 405 is provided to assist the user in correctly aiming the barrel 401, and determining an appropriate time delay between launch of the projectile 300 and deployment of the net 200, to facilitate successful capture of the target object.

The skilled person will appreciate that the aiming system 405 described herein may be used to assist aiming in any suitable application, system, apparatus or device in which a projectile is launched from a launcher towards a target object. In particular, the aiming system 405 described herein is not limited to use with launchers and/or projectiles of the types described herein, and is not limited to use in a system for deploying a first object for capturing, immobilising or disabling a second object.

Furthermore, the skilled person will appreciate that the aiming system 405 described herein may be modified as appropriate according to the specific application to which it may be applied.

For example, in the exemplary embodiments described herein, the aiming system 405 is configured to control aim of the barrel 401 such that the projectile 300 itself preferably does not intercept the target object. However, in other applications in which it is desired for the projectile to directly hit or intercept the target object, then the aiming system may be configured to control aim of the barrel such that the projectile does intercept the target object. For example, based on a measured and/or predicted position(s) and/or trajectory of the target object, the aiming system may determine a barrel direction such that the resulting trajectory of the projectile results in a situation in which the target object and the projectile collide.

As another example, in applications in which timing is not used or required, for example applications in which the projectile is not used to deploy another object (e.g. a net), or application in which the projectile is used to deploy another object without using timing, then the features relating to timing described herein (e.g. calculation of a timing parameter) may be omitted from the aiming system.

The aiming system 405 comprises a sight 429, a range finder 431, a direction sensor 433, a processor 435, an actuator 437, and an attachment means 439. The aiming system 405 may also comprise one or more further sensors, for example a sensor for measuring wind speed and direction.

The attachment means 439 is configured for attaching the aiming system 405 to the barrel 401.

The sight 429 is configured for allowing the user to visually acquire the target object. For example, the sight 429 may comprise a conventional telescopic gun sight. The range finder 431 is configured for continuously (e.g. periodically) measuring the distance to the target object in the direct line of sight as the user tracks the target object, and for continuously (e.g. periodically) providing the measured distances to the processor 435. For example, the range finder 431 may comprise a conventional laser range finder. The sight 429 and the range finder 431 may be rigidly fixed together to form a single tracking unit 441. In certain embodiments, the aiming system 405 may be configure to display the distance to the target object, as measured by the range finder 431, to the user (e.g. through the sight 429).

The direction sensor 433 is configured for continuously (e.g. periodically) measuring the direction of the target object (e.g. by measuring the orientation and/or changes in orientation of the sight 429) as the user tracks the target object, and for continuously (e.g. periodically) providing the measured direction to the processor 435. For example, the direction sensor 433 may comprise one or more (e.g. three) accelerometers, one or more (e.g. three) gyroscopes, and/or a magnetometer.

The direction sensor 433 is configured to measure the zenith (or polar) angle of the target object (i.e. the elevation angle between an imaginary horizontal plane and an imaginary line connecting the tracking unit 441 and the target object.

In certain embodiments, the direction sensor 433 may also be configured to measure the azimuthal angle of the target object with respect to a fixed reference (e.g. magnetic pole). However, this skilled person will appreciate that measuring the azimuthal angle may not be required in some circumstances. For example, in some cases, the movement of the target object may be such that the change in the azimuthal angle of the target object within a typical flight time of the projectile 101 is relatively small. In such cases, the azimuthal angle of the direct line of sight at the time the projectile 101 is launched may provide a sufficiently reliable azimuthal angle for computing correct aiming of the barrel 401.

The processor 435 is configured for computing a direction in which the barrel 401 should be orientated and a timing parameter for deployment of the net 200 for successful capture of the target object. This computation is performed based on the measured distance and direction of the target object, and may take into account one or more other factors, such as aerodynamic drag on the projectile 300, and wind speed and direction. The processor 435 is further configured to control the actuator to adjust the orientation of the barrel according to the computed direction, and to output the computed timing parameter to the control circuitry 409.

The actuator 437 is connected between the attachment means 439 and the tracking unit 441, and is configured for adjusting the relative orientation between the attachment means 439 (and hence the barrel 401) and the tracking unit 441, under the control of the processor 435. For example, the actuator 437 may be configured for adjusting the zenith angle of the barrel 401 with respect to the tracking unit 441.

In certain embodiments, the actuator 437 may also be configured for adjusting the azimuthal angle of the barrel 401 with respect to the tracking unit 441. For example, adjusting the azimuthal angle may be advantageous in cases where the azimuthal angle of the direct line of sight does not provide a suitable azimuthal angle for correctly aiming the barrel 401 (e.g. as a result of relatively fast motion of the target object, or certain forces acting on the projectile 300, such as side wind). However, this skilled person will appreciate that adjusting the azimuthal angle may not be required in some circumstances.

The actuator 437 may comprise one or more linear motors, for example.

The processor 435 is configured for outputting an aim verification signal to the control circuitry 409 when the actuator 437 has adjusted the relative orientation according to the computed values, indicating that the barrel 401 is correctly orientated. The processor 435 may discontinue outputting the aim verification signal if the barrel 401 is no longer correctly orientated (e.g. due to movement of the target object and/or the launcher).

Figure 13A:
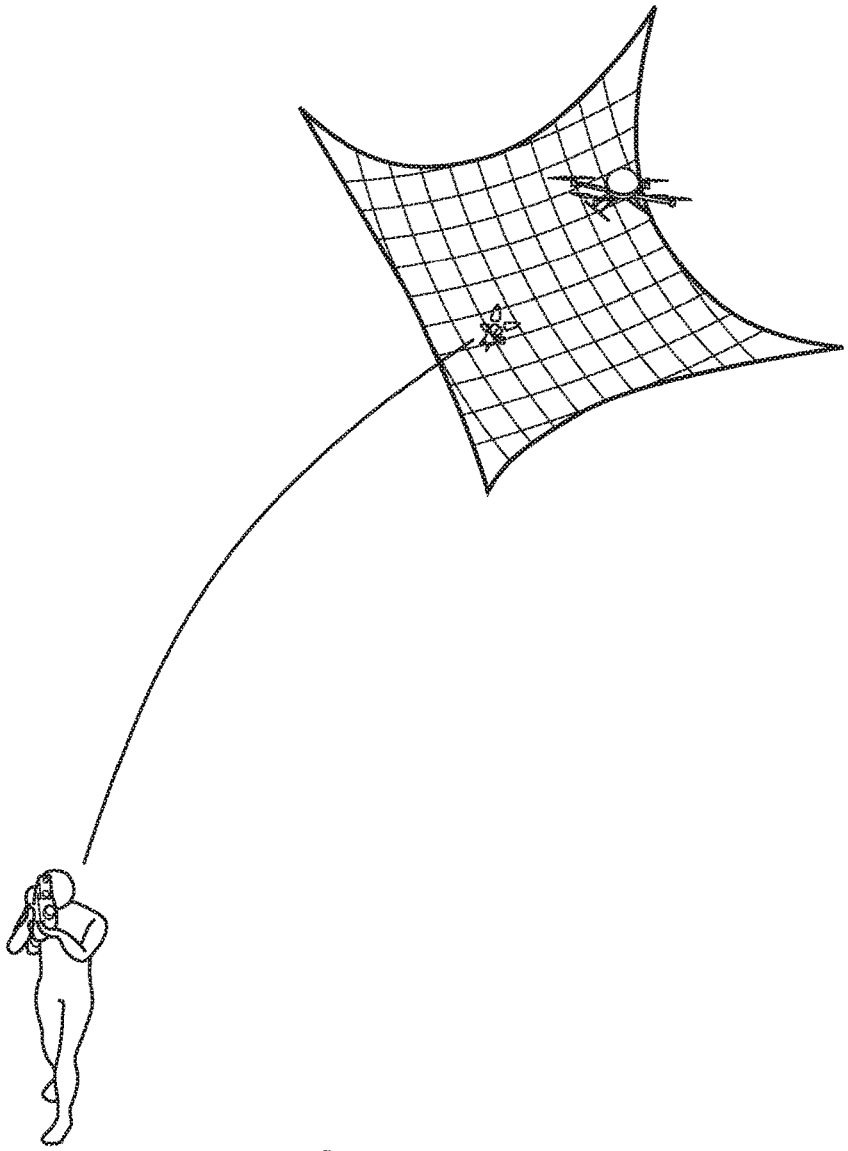
FIGS. 13*a* and 13*b* illustrate an exemplary net deployment position on a projectile flight trajectory.
Figure 13B:
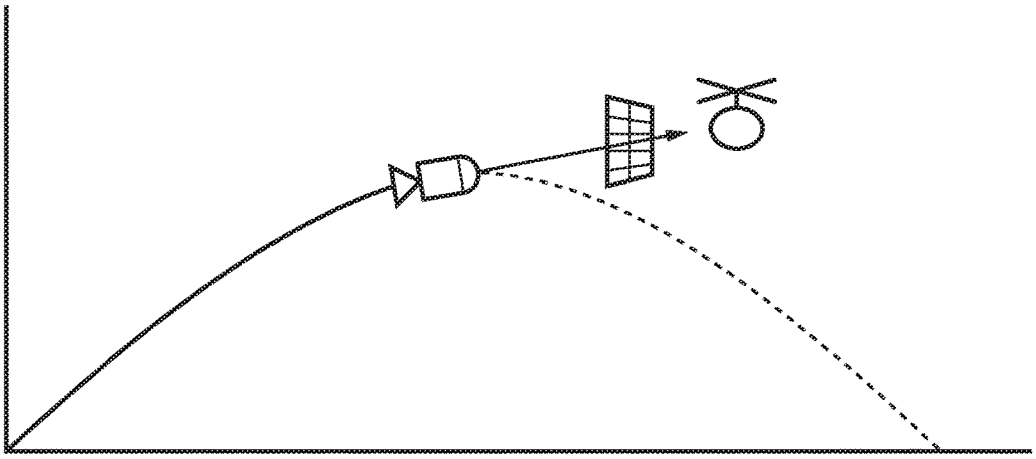

The processor 435 is configured to determine a barrel direction such that when the projectile 300 is launched in that direction with a known muzzle velocity, the resulting trajectory of the projectile 300 includes an optimum net deployment position. An optimum net deployment position is a position in the vicinity of the target object such that if the net 200 were to be deployed in that position the net 200 would intercept the target object. For example, an optimum net deployment position may be a position such that the target object is forward of the projectile 300 in the direction of flight, with an offset distance between the projectile 300 and target object that allows the net to be deployed and expand to its full size before intercepting the target object. Preferably, the barrel direction is determined such that the projectile 300 itself does not intercept the target object, to avoid damage to the projectile 300 and/or the target object. FIGS. 13*a* and 13*b* illustrate an exemplary net deployment position on a projectile flight trajectory.

Once the barrel direction has been determined, the processor may compute the time of flight from exit of the projectile 300 from the barrel 401 to the net deployment position. The processor 435 may then add an offset to the computed time of flight to take into account the time required for the projectile 300 to exit the barrel 401 following launch. This offset may depend on various factors, including barrel length and muzzle velocity. The resulting value may be used as the timing parameter that is output to the control circuitry 409.

In the embodiments described herein, the timing parameter is computed by the launcher 103. However, in alternative embodiments, the timing parameter may be input by the user.

The way in which the barrel direction is determined may depend on whether the target object is moving or is static (or moving sufficiently slowly to be regarded as static). In the case that the target object is moving, the processor 435 may be configured to track the trajectory of the target object based on the distance measurements received from the range finder 431 and the direction measurements received from the direction sensor 433. For example, the measured distance to the target object may be expressed in terms of a radial distance, and the measured direction of the target object may be expressed in terms of a zenith angle and an azimuthal angle. Accordingly, the measured distance and measured direction at a given time point together provide spherical coordinates of the target object at that time point. By determining the coordinates of the target object at different time points, the trajectory of the target object may be tracked. The processor 435 may input the tracked trajectory into a suitable motion model to predict the future trajectory of the target object.

The predicted position of the target object may be used when determining the barrel direction and/or timing parameter. For example, in a first step, the processor 435 computes the current location of the target object based on a current measured distance and direction. In a second step, the processor 435 computes a barrel direction assuming the current location of the target object. In a third step, the processor 435 computes the time of flight to the optimum net deployment position assuming the current location of the target object. In a fourth step, the processor 435 computes the predicted location of the target object after the computed time of flight. The processor then repeats the third step to compute a more accurate time of flight for the predicted position. The fourth step and third step are repeated until the change in the computed time of flight between successive iterations is lower than a certain threshold.

The trajectory of the projectile 300 may be computed using any suitable technique and may take into account any suitable factors. One example of computing a trajectory taking into account the effects of gravity and drag on the projectile 300 is described below. However, the skilled person will appreciate that the present invention is not limited to this example, and that other factors (e.g. wind speed and direction, or aerodynamic forces other than drag, such as lift) may be taken into account. In the following example, the trajectory is calculated numerically in discrete time steps, Δt. However, the skilled person that any other suitable numerical or analytic method may be used.

Taking into account the effects of gravity only, the relationship between the velocity of the projectile 300, $\underline{v}$, at the current time step, t, and the previous time step, t-1, may be given by:

$$\underline{v}^{(t)}=\underline{v}^{(t-1)}-g\Delta t\hat{\underline{y}}$$

where $\underline{v}^{(t)}$ and $\underline{v}^{(t-1)}$ are the velocities of the projectile at times t and t-1, respectively, g is the acceleration due to gravity (9.81 $ms^{-2}$), Δt is the time step between times t and t-1, and $\hat{\underline{y}}$ is a unit vector in the positive y direction (i.e. vertically upwards).

Taking into account the effects of gravity and one or more other factors, the relationship between the velocity of the projectile 300, $\underline{v}$, at the current time step, t, and the previous time step, t-1, may be given by:

$$\underline{v}^{(t)}=\underline{v}^{(t-1)}+(\underline{F}/m-g\hat{y})\Delta t$$

where m is the mass of the projectile 300 and $\underline{F}$ is a general force vector representing the total resultant force acting on the projectile due to one or more factors other than gravity. For example, the force vector, $\underline{F}$, may comprise one or more constant components and/or one or more variable components that are dependent on one or more parameters, for example time, velocity, speed and/or position. In one example, the force vector may consist of a drag force component, $\underline{F}_D$, only. The drag force may be modelled as:

$$\underline{F}=\underline{F}_D=-C_D\tfrac{1}{2}\rho v^2|\underline{v}|$$

where $C_D$ is a dimensionless drag coefficient of the projectile 300, ρ is the air density, and v is the magnitude of the velocity of the projectile 300, $v=|\underline{v}|=\sqrt{(v_x^2+v_y^2)}$. The drag coefficient, $C_D$, may be experimentally determined. In certain embodiments, the drag coefficient may be in the order of 0.5.

The relationship between the position, $\underline{u}$, of the projectile 300 at the current time step, t, and the previous time step, t-1, is given by:

$$\underline{u}^{(t)}=\underline{u}^{(t-1)}+\underline{v}^{(t-1)}\Delta t$$

where $\underline{u}^{(t)}$ and $\underline{u}^{(t-1)}$ are the positions of the projectile 300 at times t and t-1, respectively.

Given certain initial conditions, comprising a projectile position $\underline{u}^{(t0)}$ and velocity $\underline{v}^{(t0)}$ at an initial time step $t_0$, (for example, derived from the position and velocity of the projectile 300 on exit from the barrel 401), the above equations may be used to determine the positions and velocities of the projectile 300 at subsequent time steps in an iterative manner, and hence predict the trajectory of the projectile 300.

In certain embodiments, the calculations described above may be performed in real-time. In other embodiments, the calculations may be pre-computed in advance and stored in one or more look-up tables. In the latter case, a set of calculations may be pre-computed based on a range of values of one or more parameters of the aiming system. Then, at the point of use, the actual values of the parameters are determined and used to select the corresponding value from the appropriate look-up table. This approach reduces the processing requirements.

In the calculation described above, it is necessary to know the muzzle velocity of the projectile 300 in order to correctly compute the trajectory of the projectile 300. The muzzle velocity of the projectile 300 may be determined by one or more factors, for example including the mass of the projectile 300, the frictional forces between the projectile 300 and the barrel 401 of the launcher 400 as the projectile 300 moves along the barrel 401, and the launch pressure of the pressure chamber 403. If all of these factors remain fixed (or only vary slightly) then the muzzle velocity of the projectile 300 may be known in advance to a certain degree of accuracy.

However, if one or more of these factors varies, then the muzzle velocity of the projectile 300 may also vary. For example, in some cases, the launch pressure of the pressure chamber 403 may vary slightly for different launches. In this case, the values of any varying factors (e.g. launch pressure of the pressure chamber 403) may be measured or determined during use and the measured or determined values may be used to dynamically determine (e.g. using calculations and/or look-up tables) the muzzle velocity of the projectile 300. In the case that the above-described calculations are performed in advance and stored in look-up tables, calculations may be performed for a range of values of each varying factor. For example, in certain embodiments, the launch pressure of the pressure chamber 403 may be measured at the time of launch and the measured value used to index appropriate look-up tables.

As the user tracks the target object, the processor 435 may continually determine the appropriate barrel direction, control the actuator to continually adjust the barrel direction, and continually compute the corresponding timing parameter. Accordingly, if the target object is moving (and/or if the launcher is moving), then correct aiming and timing may be maintained.

In certain embodiments, the timer 315 of the projectile 300 may be continually reprogrammed with the most up-to-date timing parameter. In this case, the aiming system 405 may be configured to continually output the computed timing parameters to the appropriate contact 417 of the launcher 400 (either directly or via the control circuitry 409). In other embodiments, the timer 315 of the projectile 300 may be programmed once immediately before launch of the projectile 300. In this case, the aiming system 405 may be configured to output the most up-to-date timing parameter to the appropriate contact 417 of the launcher 400 (either directly or via the control circuitry 409) immediately prior to launch, or alternatively, to continually output the computed timing parameters to the control circuitry 409, which outputs the most up-to-date timing parameter to the appropriate contact 417 immediately prior to launch.

The processor 435 is configured to verify that a target object is being validly tracked, for example based on the measured distance and direction of the target object. For example, the processor 435 may be configured to verify valid tracking only if the measured line of sight distance to the target object is greater than a certain threshold. Accordingly, only relatively distant objects (typical of aerial vehicles) can be validly tracked. In addition, the processor 435 may be configured to verify valid tracking only if the measured line of sight distance to the target object and the measured direction of the target object have rates of change that are lower than certain thresholds. Accordingly, any tracking that switches focus between different objects would not be verified as valid tracking. The processor 435 is configured to output a tracking verification signal to the control circuitry 409 to indicate when a target object is being validly tracked and to discontinue output of the tracking verification signal when a target object is no longer being validly tracked.

In the embodiment described above, the user may support the launcher 400 via a support 407 provided on the main body of the launcher (e.g. including the barrel 401, pressure chamber 411, etc.). In this case, if the user were to maintain the barrel 401 in a fixed position, when the actuator 437 adjusts the relative orientation between the barrel 401 and the tracking unit 441, the sight 429 of the tracking unit 441 may tend to shift away from the target object. Accordingly, as the actuator 437 adjusts for aiming, the user should adaptively and manually adjust the orientation of the barrel 401 such that the target object remains located in the appropriate aim position of the sight 429 (e.g. reticule or crosshair). With this configuration, the actuator 437 only needs to support the weight and movement of the tracking unit 441. Since the tracking unit 441 is relatively light, the actuator 437 may be relatively small and have a relatively simple design.

Alternatively, in certain embodiments, the user may support the launcher 400 via a support provided on the tracking unit 441 (instead of the barrel 401). In this case, the user is not required to manually adjust the orientation of the barrel 401 as the actuator 437 adjusts for aiming. However, with this configuration, the actuator 437 should be sufficiently robust to support the combined weight of the main body of the launcher 400 and the projectile 101.

Launcher Loading and Launching Sequence

Figure 15:
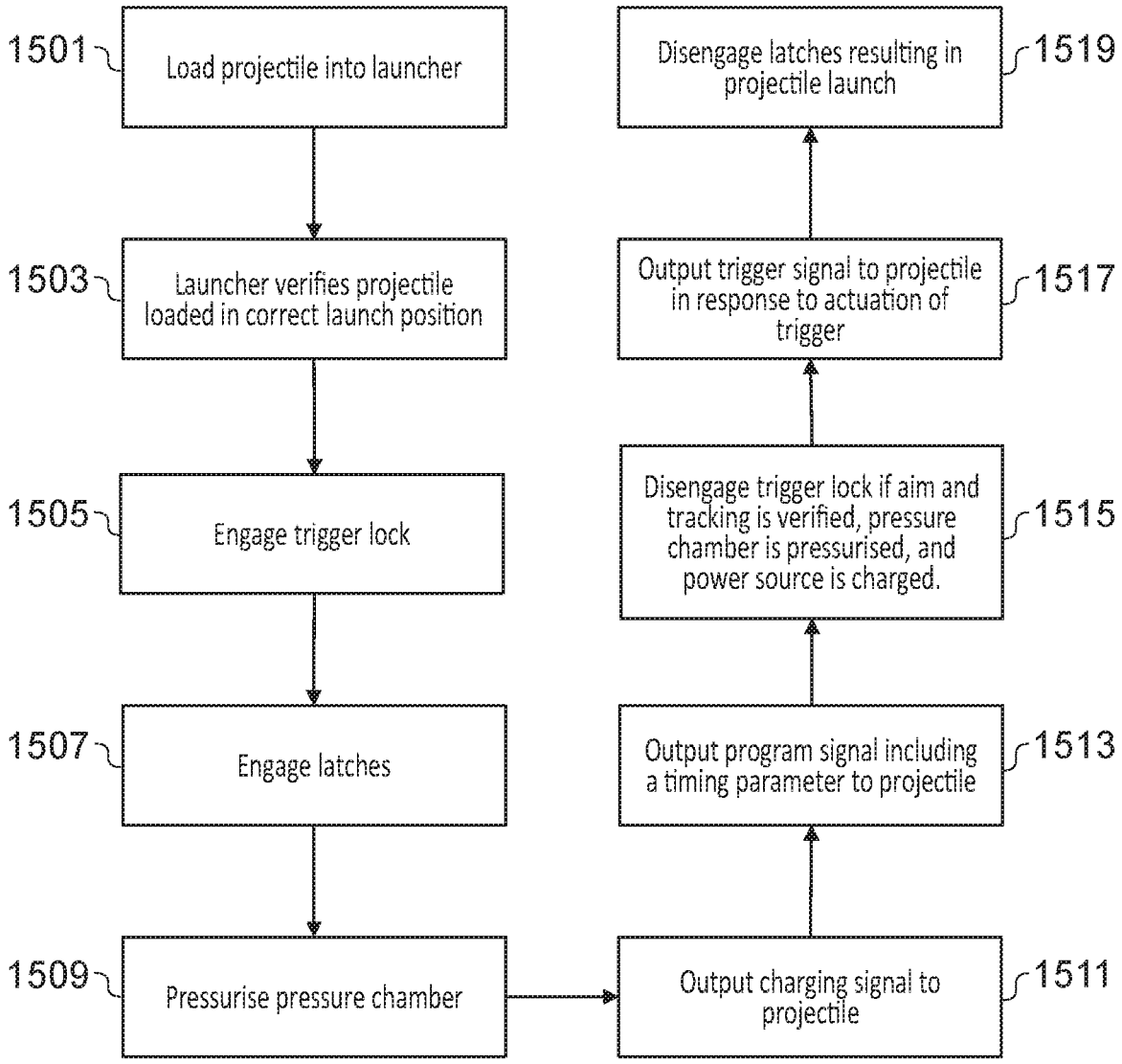
FIG. 15 is a flow diagram of an exemplary loading and launching sequence.

A loading and launching sequence of the launcher 400 will now be described with reference to FIG. 15. The skilled person will appreciate that certain steps of FIG. 15 may be performed in a different order in alternative embodiments.

First, the projectile 300 is loaded into the barrel 401 by the user to assume the correct launch position (Step 1501). At this point, actuation of the trigger 425 may be physically prevented by the trigger lock. Next, the detection circuit provided in the control circuitry 409 of the launcher 400 detects that the projectile 300 is located at the launch position (Step 1503). At this point, actuation of the trigger 425 may be physically prevented by the trigger lock (Step 1505).

In response to detecting the correct launch position of the projectile 300, the control circuitry 409 (i) controls the latches to engage, thereby restraining the projectile 300 in the launch position (Step 1507), (ii) controls the gas regulation valves 427 to open, thereby pressurising the pressure chamber 411 to a predetermined pressure (Step 1509), and (iii) outputs a charging signal to the appropriate contact 417, thereby charging the power source 313 of the projectile 300 (Step 1511).

Meanwhile, the user tracks a target object using the scope of the aiming system 405. In certain embodiments, the user may initiate a tracking (or acquisition) phase by pressing or holding down a button, or the like, to command the aiming system 405 to being a tracking (or acquisition) phase, as described above. In response, the aiming system 405 adjusts the direction of the barrel 401 for correct aim based on the tracking, and computes a timing parameter representing the timing required for deployment of the net 200. As described above, the aiming system may output computed timing parameters continually or a most-up-to-date timing parameter on request. In the case that the timer 315 of the projectile 300 is continually programmed, the control circuitry 409 continuously outputs program signals for programming the timer 315 of the projectile 300 based on the continuously computed timing parameters (Step 1513). The aiming system 405 also outputs an aim verification signal when the barrel 401 is correctly aimed, and outputs a tracking verification signal when the aiming system 405 verifies that a target object is being validly tracked.

The aiming system 405 may be configured to provide a suitable indication (e.g. visual, audible or tactile indication) to the user when the target object is being validly tracked and/or when the barrel 401 is correctly aimed. For example, a green light may be displayed to the user (e.g. through the sight 429) when the target object is being validly tracked, and a red light may be displayed to the user (e.g. through the sight 429) when the barrel 401 is correctly aimed and the projectile 300 is ready to be fired.

The control circuitry 409 may be configured to disengage the trigger lock (Step 1515), thereby allowing the user to actuate the trigger, when (i) both an aim verification signal and a tracking verification signal are received from the aiming system 405, (ii) the pressure chamber 411 is pressurised to the correct level, and (iii) the power source 313 of the projectile 300 has been charged. If either the aim verification signal or the tracking verification signal is discontinued while the user is attempting to track the target object (indicating that the barrel 401 is no longer oriented in the correct direction or that a valid target object is no longer being tracked) then the trigger lock may be re-engaged. The indications to the user may also be modified accordingly.

If the trigger lock is disengaged and the user actuates the trigger 425, the control circuitry 409 outputs a program signal for programming the timer 315 of the projectile 300 (in the case that the timer 315 is not continually programmed as described above), and a trigger signal for triggering the timer 315 of the projectile 300, to the relevant contacts 417 (Step 1517).

Immediately after outputting the trigger signal, the control circuitry 409 controls the latches 419 to disengage, resulting in launch of the projectile 300 (Step 1519).

In the embodiments described above, the timing of net deployment is determined based on a timing parameter computed by the launcher 103 and transmitted to the projectile 101. However, in other embodiments the timing of net deployment may be determined in other ways. For example, instead of using a timing parameter, the control circuitry 303 of the projectile 101 may comprise a proximity sensor for detecting the proximity of another object. In this case, the control circuitry 303 may initiate net deployment when the proximity sensor has detected another object within a certain range of the projectile 101 (but after valid launch of the projectile has been detected). In some embodiments, a proximity sensor may be used in combination with a timing parameter to improve the accuracy of timing of net deployment.

In yet further alternative embodiments, the launcher 103 may determine a timing parameter but not transmit the timing parameter or a trigger signal to the projectile 101. Instead, the launcher 103 may wirelessly transmit a net deployment trigger signal to the projectile 101 at the appropriate deployment time following launch. The control circuitry 303 may initiate net deployment upon receipt of the net deployment trigger signal. In this case, the timer 315 of the projectile 101 may be omitted.

The invention claimed is:

1. A system for deploying a first object for capturing, immobilising or disabling a second object, the system comprising:

the first object;

a projectile for carrying the first object therein, wherein the projectile comprises a projectile body including a first compartment for storing the first object, a first deployment mechanism for deploying the first object, and control circuitry for activating the first deployment mechanism; and a launcher for launching the projectile towards the second object, wherein the launcher comprises:

a barrel configured to receive the projectile;

a launching mechanism for launching the projectile;

an aiming mechanism for aiming the barrel, wherein the aiming mechanism comprises:

an attachment means for attaching the aiming mechanism to the barrel;

a sight for allowing a user to visually acquire a target object;

a range finder for measuring the distance to the target object in a direct line of sight;

a direction sensor for measuring the direction of the target object, including at least the zenith angle of the target object with respect to a horizontal plane;

an actuator for adjusting the direction of the barrel relative to the direct line of sight, including at least the zenith angle; and a processor for controlling the actuator to adjust the direction of the barrel based on the measure distance and direction of the target object; and control circuitry for controlling the launching mechanism, wherein the projectile is configured for deploying the first object in the vicinity of the second object for capturing, immobilising or disabling the second object.

2. A system according to claim 1, wherein the processor is configured to:

determine a barrel direction such that when the projectile is launched in the determined direction with a known muzzle velocity, the resulting trajectory of the projectile includes a deployment position in the vicinity of the target object; and control the actuator to adjust the direction of the barrel to the determined direction.

3. A system according to claim 2, wherein the processor is configured to compute a flight time of the projectile to the deployment position, and to output a timing parameter based on the determined time of flight.

4. A system according to claim 1, wherein the processor is configured for tracking the trajectory of the target object based on the measured distance and direction of the target object, and wherein the processor is configured to predict the future trajectory of the target object based on the tracked trajectory, and to determine the barrel direction based on the predicted trajectory of the target object.

5. A system according to claim 1, wherein the actuator is further configured to adjust the azimuthal angle of the barrel.

6. A launcher configured to launch a projectile towards a target object, the launcher comprising:

a barrel configured to receive the projectile;

a launching mechanism for launching the projectile;

an aiming mechanism for aiming the barrel; and control circuitry for controlling the launching mechanism, wherein the aiming mechanism comprises:

an attachment means for attaching the aiming mechanism to the barrel;

a sight for allowing a user to visually acquire the target object;

a range finder for measuring a distance to the target object in a direct line of sight;

a direction sensor for measuring a direction of the target object, including at least the zenith angle of the target object with respect to a horizontal plane;

an actuator for adjusting a direction of the barrel relative to the direct line of sight, including at least the zenith angle; and a processor for controlling the actuator to adjust the direction of the barrel based on the measure distance and direction of the target object.

* * * * *